United States Patent [19]

Klein-Albenhausen

[11] 4,391,528

[45] Jul. 5, 1983

[54] SILO SYSTEM FOR MIXING STORED MATERIAL

[75] Inventor: Heinrich Klein-Albenhausen, Hamburg, Fed. Rep. of Germany

[73] Assignee: Ibau Hamburg Ingenieurgisillschaft Endustreibau mbH, Hamburg, Fed. Rep. of Germany

[21] Appl. No.: 190,662

[22] Filed: Sep. 25, 1980

Related U.S. Application Data

[63] Continuation-in-part of Ser. No. 811,618, Jun. 30, 1977.

[51] Int. Cl.[3] ..... B28C 5/00; B28C 7/04

[52] U.S. Cl. ..... 366/15; 366/29; 366/37; 366/153; 366/154; 366/341; 406/23

[58] Field of Search ..... 366/15, 21, 29, 101, 366/106, 107, 132, 153, 154, 340, 341, 37; 222/195; 406/19, 23–26

[56] References Cited

U.S. PATENT DOCUMENTS

| | | | |
|---|---|---|---|
| 2,385,494 | 9/1945 | Boynton | 366/181 |
| 2,907,605 | 10/1959 | Brooks | 406/24 |
| 3,003,752 | 10/1961 | Frost | 366/106 |
| 3,158,362 | 11/1964 | Scifarth | 366/134 |
| 3,188,144 | 6/1965 | Gmür | 222/195 |
| 3,291,457 | 12/1966 | Hermanns | 366/107 |
| 3,499,577 | 3/1970 | Nilsson | 222/195 |
| 3,506,111 | 4/1970 | Eppenberger | 406/24 |
| 3,656,717 | 4/1972 | Klein et al. | 366/106 |
| 3,871,629 | 3/1975 | Hishida | 366/181 |
| 3,913,891 | 10/1975 | Steele | 366/192 |
| 4,002,323 | 1/1977 | Grun | 366/102 |
| 4,006,888 | 2/1977 | Emmons | 366/153 |
| 4,078,703 | 3/1978 | Dressler | 222/195 |
| 4,184,774 | 1/1980 | Krauss | 366/341 |
| 4,200,412 | 4/1980 | Steele | 406/24 |
| 4,221,509 | 9/1980 | Balzau et al. | 222/195 |
| 4,239,421 | 12/1980 | Krauss | 366/106 |
| 4,273,451 | 6/1981 | Krauss | 366/341 |

FOREIGN PATENT DOCUMENTS

| | | | |
|---|---|---|---|
| 194324 | 3/1957 | Austria | 222/195 |
| 1299475 | 7/1969 | Fed. Rep. of Germany . | |
| 2109287 | 2/1972 | Fed. Rep. of Germany | 222/195 |
| 2508981 | 9/1976 | Fed. Rep. of Germany . | |
| 2724928 | 12/1978 | Fed. Rep. of Germany | 366/341 |

OTHER PUBLICATIONS

Continuously Operating Raw Meal Blending Installation, 10/1977.
Technische Arbeitsblatter, Apr. 1971.
Elements and Plants, Dec. 1977, IBAU.
Grossraumsilos mit Mischeffekt, Nov. 1971, Zement, Kalk, Cips, pp. 512–514.
Cement Data Book, 1977.

*Primary Examiner*—Billy S. Taylor
*Attorney, Agent, or Firm*—Staas & Halsey

[57] ABSTRACT

A silo for mixing dried and powdery materials such as cement. A number of discharge apertures positioned at different places at the bottom of a mixing silo are connected by conduits to a common receptacle such as an homogenizing silo. A flow control gate is coupled to each discharge aperture to allow material flow to the receptacle to be controlled. Three modes of operation are disclosed: a single flow-mode wherein the flow control gates are opened sequentially one at a time, a dual-flow-same-rate mode wherein pairs of flow control gates are sequentially opened to the same extent, and a dual-flow-different-rate mode wherein pairs of flow control gates are sequentially opened to different extents. A level sensor in the homogenizing silo is connected to a level indicator circuit which emits level indicator signals indicating whether the material in the receptacle is rising or falling, thereby allowing automatic adjustment of the material flow rate into the receptacle up to a predetermined cut-off level. A flow control gate selector circuit connected to a variable timer and to a mode control circuit selects which flow control gates will be opened, and an alternator for every pair of flow control gates is connected to the mode control circuit and to the flow control gate selector circuits to vary the flow rate during different alternator periods when the dual-flow-different-rate mode is selected.

34 Claims, 20 Drawing Figures

SILO SYSTEM FOR MIXING STORED MATERIAL

CROSS-REFERENCE TO RELATED APPLICATION

This application is a continuation-in-part of Application, Ser. No. 811,618, filed June 30, 1977.

BACKGROUND OF THE INVENTION

The present invention relates to silos for mixing stored granular or powdery materials, such as raw meal for cement. The invention is particularly adapted for use with a large mixing silo combined with a small homogenizing silo to produce thorough homogenization at a relatively low cost.

In the cement industry it is frequently desirable for a manufacturer to guarantee the calcium carbonate percentage of his product. However, the calcium carbonate content of a truckload of raw material from the quarry may vary 15% or more from the desired figure, with these variations slowly changing from truckload to truckload from too much calcium carbonate to too little. The variations may be reduced to the 5% range during preliminary processing at the cement mill, but final mixing is generally necessary in order to reliably achieve the guaranteed percentage of calcium carbonate.

Mixing silos have long been used in the silo art due to their modest energy requirements. A stream of incoming nonhomogenious material is poured into the silo, forming layers of differing consistency at different vertical distances from the silo bottom. Lateral inconsistencies from one side of the silo to the other may also form. When a discharge aperture at the bottom of the silo is opened the stored material rushes out, the stored layers sagging into a cone-shapped depression above the opened aperture. When the layers sag they also thin, so that a given quantity of material collected at the discharge aperture contains samples of more layers than would have been received had the same quantity of material been scooped up by a workman who climbed into the silo. Additionally, the discharge process creates turbulence which enhances the mixing effect.

Nevertheless, the performance of the mixing silo is relatively poor. The layer-thinning effect of a discharge aperture is most pronounced for the material directly above it, and material to either side participates inadequately in the mixing process. There is also the problem that a cone might grow too deep, so that incoming material might "punch through" to the discharge aperture without undergoing much mixing. A number of workers in the art have tried to enhance the performance of mixing silos via a variety of expedients, including providing different discharge apertures at different positions on the silo floor around the periphery of a conical hood, but the fact remains that the performance of mixing silos is inadequate for many purposes.

Homogenizing silos are also well known in the art. Basically, material is stored in an homogenizing silo and air is blown through it to create turbulence which thoroughly mixes the stored material. The silo should be filled to a proper level and not above, since an adequate empty space or head room must be maintained in order to ensure proper mixing. After mixing has been completed, the homogenized material is removed for use and a new batch of nonhomogeneous material replaces it. Homogenizing silos typically have a large capacity since it is desirable to include material having the entire range of variations within a single batch. The mixing performance of a large-capacity homogenizing silo is excellent, but vast amounts of compressed air are required for proper performance. This compressed air is becoming more expensive as energy supplies dwindle. Moreover, the necessity for batch processing is frequently disadvantageous. The energy input requirements for mixing silos are considerably less severe, since mixing is produced by gravity rather than compressed air, and additionally mixing silos offer the convenience of continuous processing. Nevertheless, as mentioned above, the performance of mixing silos is inadequate for many applications.

Applicant's parent application disclosed a relatively large mixing silo having a conical hood at the base thereof and discharge apertures spaced around the periphery of the conical hood, the discharge apertures being connected by conduits each provided with a flow control gate to a relatively small homogenizing silo positioned beneath the conical hood. The flow control gates are sequentially opened to allow material to flow into the homogenizing silo until a level recorder mounted therein signals that the material level for proper mixing has been achieved. The application mentioned the possibility of opening two flow control gates simultaneously and varying the rate at which material is discharged through them, but did not disclose how to do so.

SUMMARY OF THE INVENTION

One object of the present invention is to provide a combination of a mixing silo and homogenizing silo which provides the advantages of each while minimizing their disadvantages.

Another object of the present invention is to provide a silo combination which allows material to flow into the homogenizing silo up to a predetermined cut-off point and which thereafter allows a considerable quantity of homogenized material to be removed before the flow control gates are allowed to open again.

Another object of the present invention is to provide a silo combination which reduces the flow rate into the homogenizing silo before the cut-off point is reached.

Another object of the present invention is to provide a silo system wherein a plurality of discharge apertures are simultaneously opened in a cyclical sequence in order to reduce lateral variations and the possibility of punch through. Furthermore, the discharge apertures may be opened to different extents to allow simultaneous receipt of material from different layers in order to reduce vertical variations.

Another object of the present invention is to provide a silo system which allows the user to select either a single-flow mode of operation wherein material flows through one discharge aperture at a time, a dual-flow-same-rate mode of operation wherein material simultaneously flows at the same rate through opposing pairs of discharge apertures, or a dual-flow-different-rate mode of operation wherein material simultaneously flows at different rates through opposing pairs of discharge apertures.

These and other objects are attained by providing a mixing silo having a plurality of discharge apertures connected by conduits to a lower homogenizing silo or other receptacle. A level sensor in the homogenizing silo is connected to a level indicator circuit which generates level indicator signals indicating when material has reached the cut-off point and the direction of material movement just below that point. A timer circuit generates timer signals of predetermined periods for a flow control gate selector circuit which is connected to a flow control gate selector signal bus. A flow control gate is mounted on each conduit and a flow control circuit is provided for moving each flow control gate. Each flow control circuit has a circuit-enable input which is connected to the flow control gate selector signal bus, so that the flow control gate selector circuit may periodically raise the potential on the conductors of the flow control gate selector signal bus in order to cyclically select the times when the flow control gates can be opened. A mode control circuit receives the level indicator signals and allows the silo user to select either the single-flow mode, the dual-flow-equal-rate mode, or the dual-flow-different-rate mode of silo operation. The mode control circuit emits single/dual signals to the flow control gate selector circuit, which responds by enabling either one or two flow control circuits simultaneously. The mode control circuit also emits mode signals representing the level indicator signals to a mode control signal bus, to which all of the flow control circuits are connected in an identical manner. Finally, the mode circuit emits alternator input signals to alternator circuits, one of which is provided for every pair of flow control gates. Each alternator circuit keeps track of whether its corresponding flow control circuits have been enabled an odd or even number of times and combines this tabulation with level indicator signals derived from the alternator input signals to generate alternator signals for an alternator signal bus. Every other flow control circuit is connected to the alternator signal bus in an identical manner. During the time when a flow control circuit is enabled by a signal on the flow control gate selector signal bus, it responds to the signals on the alternator signal bus and the mode control signal bus along with flow control gate position signals which indicate the degree to which the flow control gate is open to drive a motor which either opens the flow control gate wider, narrows the opening, or leaves the opening unchanged.

DESCRIPTION OF THE PREFERRED EMBODIMENTS

Figure 2:
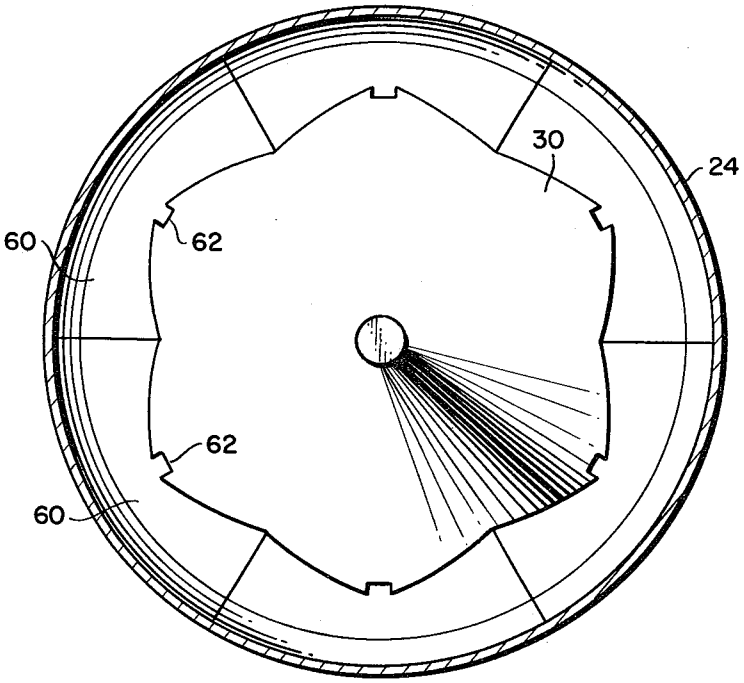
FIG. 2 is a sectional view taken along the line 2—2 of FIG. 1.
Figure 1:
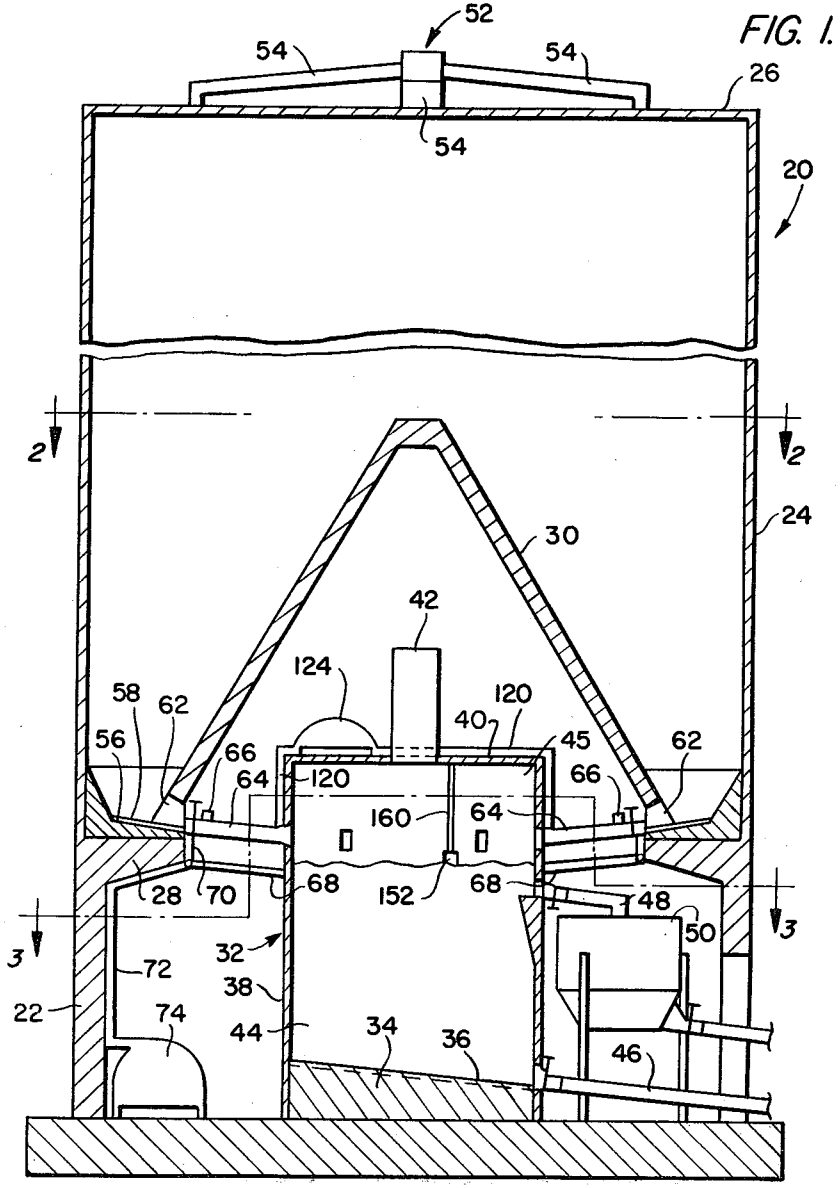
FIG. 1 is a side view illustrating a mixing silo having a conical hood at the base thereof and an homogenizing silo positioned under the hood.
Figure 3:
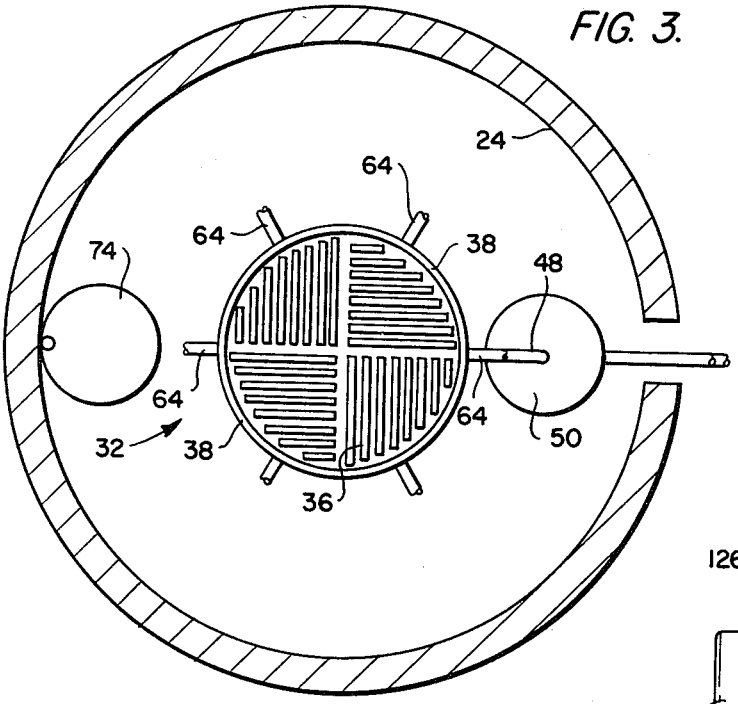
FIG. 3 is a sectional view taken along line 3—3 of FIG. 1.

FIGS. 1, 2, and 3 illustrate a mixing silo 20 having a base portion 22 supporting silo walls 24 and silo top 26. Annular portion 28 of base portion 22 supports conical hood 30, below which is positioned homogenizing silo 32. The construction and operation of suitable homogenizing silos are known in the art; see, for example, U.S. Pat. No. 3,291,457 or 3,656,717. Briefly, homogenizing silo 32 includes sloping base 34 which supports aeration elements 36, silo walls 38, and silo top 40 on which filter 42 is mounted. In operation a blower (not illustrated) blows air into homogenizing silo 32 through aeration elements 36, thereby agitating material 44 if enough head room 45 is maintained above the surface of material 44 to allow proper mixing. Air is exhausted through filter 42. After mixing, material 44 can be removed via conduit 46 or via conduit 48, which empties into weighing bin 50.

For the manufacture of cement mixing silo 20 is typically 28–44 meters tall, with the diameter being approximately half the height. This capacity allows the mixing silo to hold a two-and-a-half to three day supply of the output from a typical cement mill. Homogenizing silo 32 is typically 12 to 20 meters tall, with the diameter again being about half the height.

Distributor 52 is mounted on silo top 26 and includes conveyor troughs 54 leading to different places on top 26 so that incoming material may be distributed roughly in layers on top of material previously stored in silo 20. Annular portion 28 supports beveled base 56 on which aeration elements 58 are disposed in six sectors 60. A discharge aperture 62 is provided in the bottom of silo 20 around conical hood 30 at the center of each sector 60 to allow material to flow from silo 20 to silo 32 through the corresponding slide or conduit 64 when the corresponding flow control gate 66 is open. As will be discussed subsequently, flow control gates 66 are opened at regular intervals, when the level of material 44 in homogenzing silo 32 permits, and air is supplied to the corresponding sector 60 of aeration elements 58 to fluidize the material adjacent the opened discharge aperture 62. To this end, ring pipe 68 is supported on annular portion 28, with a distribution pipe 70 leading to each sector of aeration elements 58. Pipe 72 connects ring pipe 68 to conventional blower 74, which supplies ring pipe 68 with air at about 600 millibars pressure.

Figure 8:
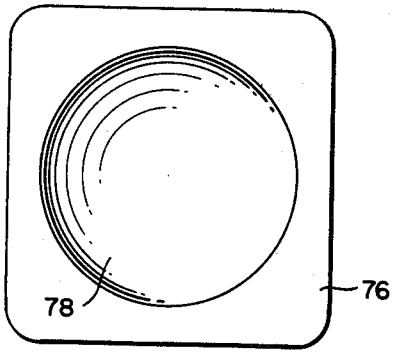
FIG. 8 is a bottom view of a porous stone which may be used as an aeration element.

A number of devices suitable for use as aeration elements 58 are known in the art, including ceramic air-pervious plates, air-pervious sintered metal plates, and air-pervious hoses. FIG. 8 illustrates the bottom of a porous brick 76 which may also be used. Brick 76 is made by using synthetic resin to fuse particles together, preferably with coarse particles on the bottom and finer particles on top. Concave area 78 is molded into the bottom of brick 76 during manufacture. To use porous bricks 76, a lattice of pipes covering each sector 60 is deposited on base 56 during manufacture of silo 20. The pipes have up-turned ends. Each lattice is pneumatically connected to the corresponding distribution pipe 70, and concrete is poured on the pipes so that only their up-turned ends protrude. Porous bricks 76 are then positioned over each of the up-turned ends, which are accommodated by the concave areas 78 on the bottom of each brick. The bricks 76 are then cemented into place, much like tiles on a floor.

Figure 4:
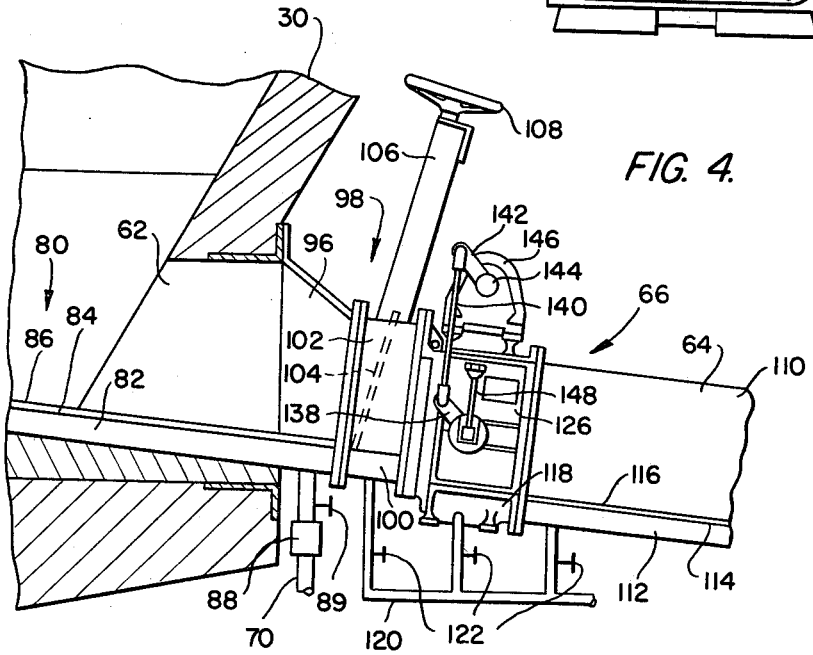
FIG. 4 is a side view of a discharge aperture and the conduit leading from it to the homogenizing silo.
Figure 10:
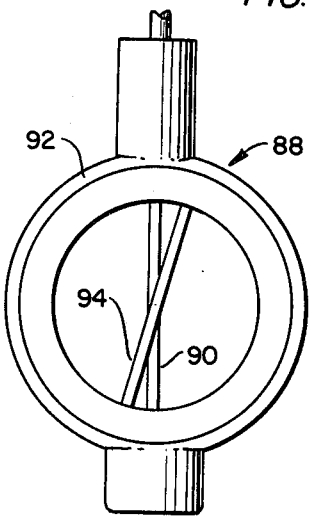
FIG. 10 is a side view illustrating a sector air control valve in the open position.

The preferred aeration elements 58 for use in the present invention, however, are fluid slides positioned at regular intervals on base 56. FIG. 4 illustrates fluid slide 80 leading to discharge aperture 62, and in practice the remaining fluid slides of the sector 60 corresponding to this discharge aperture are pneumatically connected to slide 80. Slide 80 includes an elongated shallow tray 82 covered by a metal grate 84 to which an air-pervious synthetic fabric 86 is attached. Tray 82 is pneumatically connected to pipe 70 through sector air control valve 88 and adjustment valve 89, which is provided so that the air flow to the sector 60 can be manually fine-tuned. Suitable devices for use as selector air control valve 88 are known in the art, one possibility being illustrated in FIG. 10. Shaft 90 is rotatably mounted in valve housing 92. Eccentric flap 94 is affixed to shaft 90 so that the valve 88 can be opened or closed depending upon the position of shaft 90. As is known in the art, a motor or solenoid may be mechanically coupled to shaft 90 in order to allow valve 88 to be controlled from a remote position.

With reference next to FIG. 4, in the cement industry the openings 62 are typically rectangles having dimensions of about one meter by 0.9 meters. A coupling 96 is provided to reduce this down to dimensions suitable for use with flow control gates, typically about 0.5 meters by 0.3 meters. If desired, a manual cut-off section 98 may be included between coupling 96 and flow control gate 66 so that flow control gate 66 may be removed for repair. Section 98 includes a housing bottom 100 formed as a fluid slide and a housing top 102 within which a shield 104 is slidably mounted. Column 106 extending from top 102 houses an elongated screw (not illustrated) linking handle 108 to shield 104 so that handle 108 may be rotated to raise shield 102 in order to allow material to reach flow control gate 66.

Figure 9:
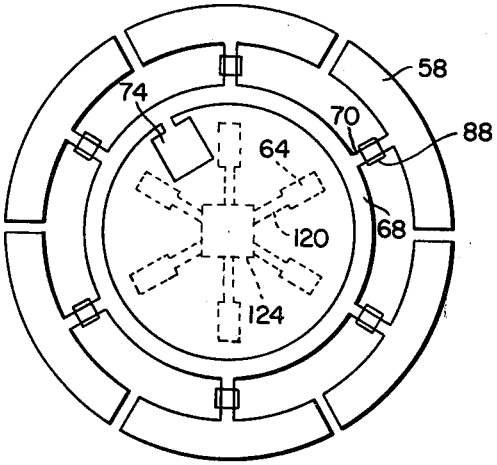
FIG. 9 is a schematic diagram illustrating the two pneumatic systems.

With continuing reference to FIG. 4, conduit 64 includes cover 110 and shallow tray 112, on top of which is mounted a grate 114 to which air-pervious synthetic fabric 116 is attached so as to form a fluid slide. The fluid slides of section 98, gate 66, and slide 64 are supplied with air through pipe 120, with valves 122 being provided to allow manual adjustment of the air flow. Conventional blower 124 (see FIG. 1) provides air for pipes 120. Since the pressure required for operation of the fluid slides supplied by blower 124, typically about 60 millibars for cement manufacture, is much less than the pressure supplied by blower 74, energy expenditure is not significantly increased if valves corresponding to sector air control valve 88 are omitted from pipes 120. Accordingly, the pipes 120 leading to each slide 64, flow control gate 66, and section 98 are continually supplied with air regardless of whether or not the flow control gate 66 is open. FIG. 9 schematically illustrates the major elements of the two pneumatic systems.

Figure 5:
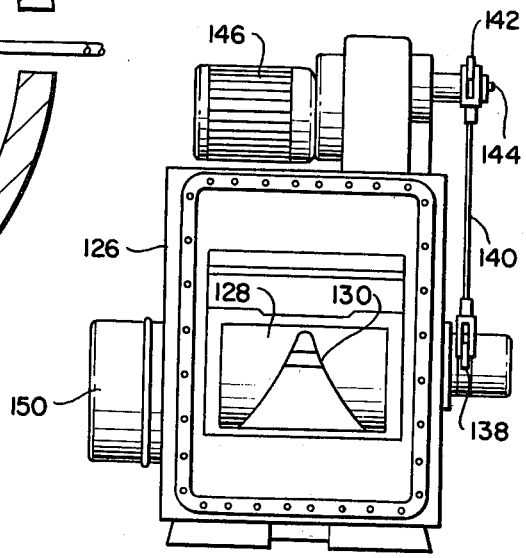
FIG. 5 is a front view of a flow control gate in a partially opened position.
Figure 6:
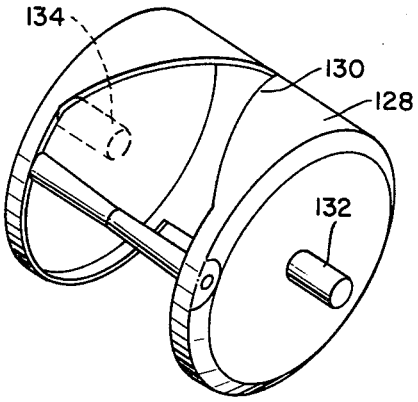
FIG. 6 is a perspective view of the rotatable cylinder of a flow control gate.

With reference next to FIGS. 4, 5, and 6, flow control gate 66 includes a housing having bottom portion 118 and top portion 126 which houses a flow control apparatus similar to the one described in West German Auslegesschrift No. 1,299,475. Briefly, a cylinder 128 having an opening 130 is rotatably mounted within portion 126 by shafts 132 and 134. It will be apparent to those skilled in the art that cylinder 128 can be used to either close flow control gate 66 or to open it to any desired percentage of the maximum opening, depending upon the angular orientation of cylinder 128. Lever 138 is attached to shaft 132, and one end of link 140 is pivotably attached at the end of lever 138. The other end of link 140 is pivotably attached to lever 142, which is affixed to motor shaft 144. Motor 146 is bolted to top portion 126. Motor 146 is a gear motor, that is, a motor coupled to an internal gear chain which drives shaft 144 at a relatively low angular velocity. It will be apparent to those skilled in the art that flow control gate 66 is opened when shaft 146 rotates in one direction, and gate 66 is closed when shaft 144 rotates in the other direction. Lever 148 is affixed to shaft 132 so that flow control gate 66 can be manually closed should motor 146 become inoperative. Subhousing 150 is attached to top portion 126 to protect a flow control gate position detector assembly connected to shaft 134. This assembly, which provides signals indicating the angular position of cylinder 128, will be described subsequently.

Although the discharge apertures 62 have been illustrated as being positioned at the base of the homogenizing silo, it may occasionally be desirable to elevate some of them to higher positions on conical hood 30. At the cost of a somewhat more complicated construction, this expedient would facilitate mixing by allowing discharge apertures direct access to material in different layers. Any of the aeration elements mentioned could be used for the adjacent sector 60 in this situation, but porous bricks 76 are particularly adapted for use on the curved surface of conical hood 30.

Figure 14:
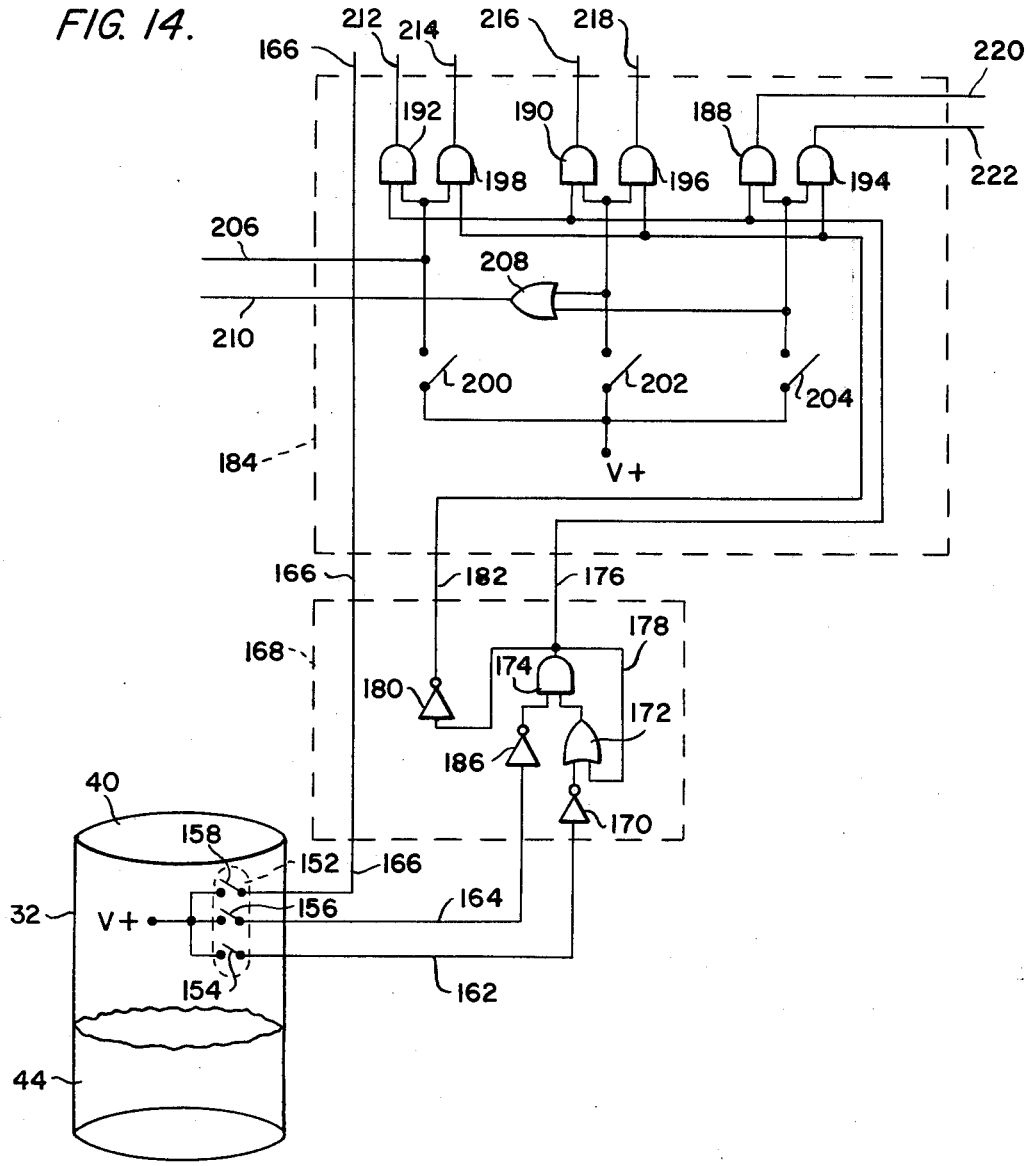
FIG. 14 is a schematic diagram illustrating a level indicator circuit and a mode control circuit.

Turning now to FIG. 14, level sensor 152 is positioned within homogenizing silo 32 and consists of bottom level switch 154, medium level switch 156, and top level switch 158. For production of cement switch 156 is typically positioned about a meter above switch 154, and switch 152 is typically positioned about a half meter above switch 156. FIG. 1 illustrates level sensor 152 suspended by a single rod 160 from top 40, but it will be apparent to those skilled in the art that the level switches may be supported on separate rods suspended from different positions on top 40. Regardless of the mounting system employed, top level switch 158 should be positioned a sufficient distance from top 40 to allow adequate head room 45. Suitable devices for use as level switches 154, 156, and 158 are known in the art, with capacitative switches being particularly suited for use in the production of cement. Such switches depend operationally upon the fact that the electrical characteristics of a capacitor change when the dielectric between its plates is charged, and employs circuitry to generate ON or OFF signals corresponding to these changing electrical characteristics.

With continuing reference to FIG. 14, each of the switches 154, 156, and 158 is open unless it is covered by material 44. Conductors 162, 164, and 166 connect switches 154, 156, and 158, respectively, to level indicator circuit 168. It will be apparent to those skilled in the art that, as material 44 rises toward top 40 from the level illustrated in FIG. 14, the potential of conductor 162 will first rise from a logical low level (designated "0" potential in this application) to a logical high level (designated as potential "1" in this application) as bottom switch 154 is covered, then the potential on conductor 164 will rise from 0 to 1 as middle switch 156 is covered, and finally conductor 166 will rise from a potential of 0 to a potential of 1 when switch 158 is covered. When material 44 is removed from silo 32 so that this level falls, the sequence is reversed.

With continuing reference to FIG. 14, conductor 162 is connected to the input of inverter 170, the output of which is provided to one input of OR gate 172. The output of OR gate 172 is provided to one input of AND gate 174, the output of which is provided as a level indicator signal on conductor 176. Feedback conductor 178 electrically connects the output of AND gate 174 to the remaining input of OR gate 172, thereby forming a memory element. The output of AND gate 174 is also connected to the input of inverter 180, the output of which is provided as a level indicator signal on conductor 182. It will be noted that the level sensor signal from top switch 158 is not altered as conductor 166 traverses level indicator 168 and mode control circuit 184; however, for convenience in description the signal carried by conductor 166 will be deemed a "level indicator signal" when conductor 166 emerges from circuit 168, and a "mode signal" when conductor 166 emerges from circuit 184.

Figure 15A:
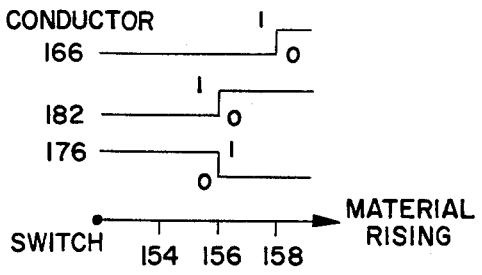
FIGS. 15(*a*) and 15(*b*) illustrate the level indicator signals when the material is rising and falling.
Figure 15B:
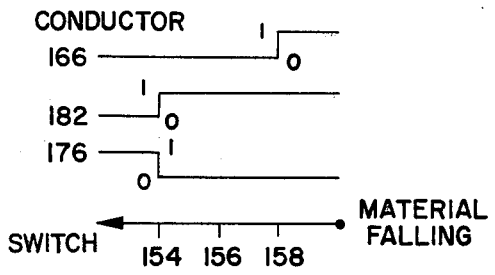

When continuing reference to FIG. 14, conductor 164 conveys the level sensor signal from switch 156 to the input of inverter 186, the output of which is provided to the remaining input of AND gate 174. It will be apparent to those skilled in the art that when the level of material 44 lies as illustrated in FIG. 14, switches 154 and 156 will both be uncovered and AND gate 174 will be on. Inverter 170 will turn OFF as material 44 rises to cover switch 154, but AND gate 174 will remain ON due to the fact that feedback conductor 178 is still providing a logical high signal to the remaining input of OR gate 172. Only when material 44 continues rising and covers switch 156 does AND gate 174 turn OFF. Should the level of material 44 thereafter recede to uncover switch 156, AND gate 174 will remain OFF since feedback conductor 178 is providing a logical low signal to the input of OR gate 172. OR gate 172 will not turn ON again until material 44 has receded past switch 154. These results are illustrated in FIGS. 15(*a*) and 15(*b*). As FIG. 15(*a*) illustrates, the level indicator signal on conductor 176 remains at a logical high potential until the level of material 44 rises from the position illustrated in FIG. 14 until switch 156 is covered, and thereafter falls to a logical low potential as material 44 continues rising. Due to inverter 180, the level indicator signal on conductor 182 will have the opposite characteristics. FIG. 15(*b*) illustrates that as the level of material 44 falls from top 40 to the position illustrated in FIG. 14, the level indicator signal on conductor 176 remains at a logical low potential until switch 154 is uncovered. Regardless of whether the material is rising or falling, the level indicator signal on conductor 166 is at a logical high potential when switch 158 is covered and at a logical low potential when it is not covered. It will be apparent to those skilled in the art that level indicator circuit 168 has a memory function, designating whether the level of material 44 is generally rising or falling as it traverses switches 154 and 156. More particularly, if the level of material 44 has been below switch 154 but has not yet traversed switch 156 again, the material is "rising" when switch 156 is next traversed and, similarly, if the material level has been above switch 156 but has not yet traversed switch 154 again, the material is "falling" the next time switch 154 is traversed. The terms "material rising" and "material falling" are to be understood in this long-term sense, without regard to movement of the material level when it lies below switch 154 or to possible minor variations when it lies above switch 154.

With continuing reference to FIG. 14, conductor 176 is connected to one of the inputs of AND gates 188, 190, and 192, while conductor 182 is connected to one of the inputs of AND gates 194, 196, and 198. One terminal of single-flow mode switch 200 is connected to the remaining two inputs of AND gates 192 and 198; one terminal of dual-flow-equal-rate mode switch 202 is connected to the remaining two terminals of AND gates 190 and 196; and one terminal of dual-flow-different-rate mode switch 204 is connected to the remaining two terminals of AND gates 188 and 194. The remaining terminals of switches 200, 202, and 204 are maintained at a logical high potential. Switches 200, 202, and 204 are mechanically coupled so that only one can be closed at a time; that is, only one of the three AND gate pairs can be turned ON at a time. Conductor 206 is electrically connected to switch 200 and provides a single/dual signal of potential 1 only if switch 200 is closed. The inputs of OR gate 208 are electrically connected to switches 202 and 204, so that conductor 210 provides a single/dual signal of potential 1 if either of switches 202 and 204 is closed. It will be apparent to those skilled in the art that when switch 200 is closed, conductor 212 connected to the output of AND gate 192 will provide a mode signal corresponding to the level indicator signal on conductor 176 and conductor 214 connected to the output of AND gate 198 will provide a mode signal corresponding to the level indicator signal on conductor 182. If switch 200 is opened both conductors 212 and 214 will be maintained at a logical low potential. Similarly, when switch 202 is closed conductor 216 connected to the output of AND gate 190 and conductor 218 connected to the output of AND gate 196 will provide mode signals corresponding to the level indicator signals on conductors 176 and 182, respectively. Finally, when switch 204 is closed, conductor 220 connected to the output of AND gate 188 and conductor 222 connected to the output of AND gate 194 will provide alternator input signals corresponding to the level indicator signals on conductors 176 and 182, respectively.

Figure 11:
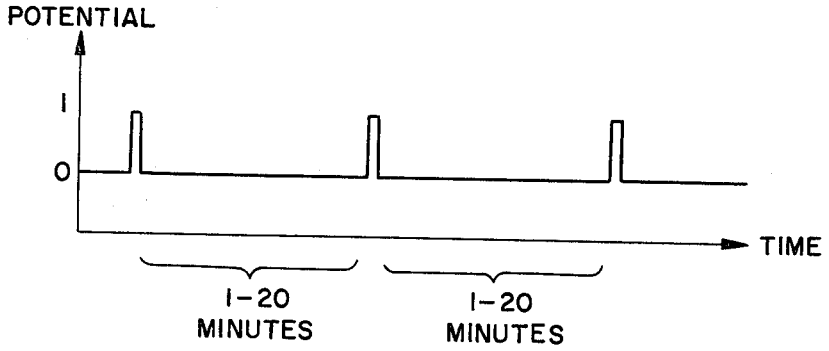
FIG. 11 illustrates the nature of the timer signal.
Figure 16:
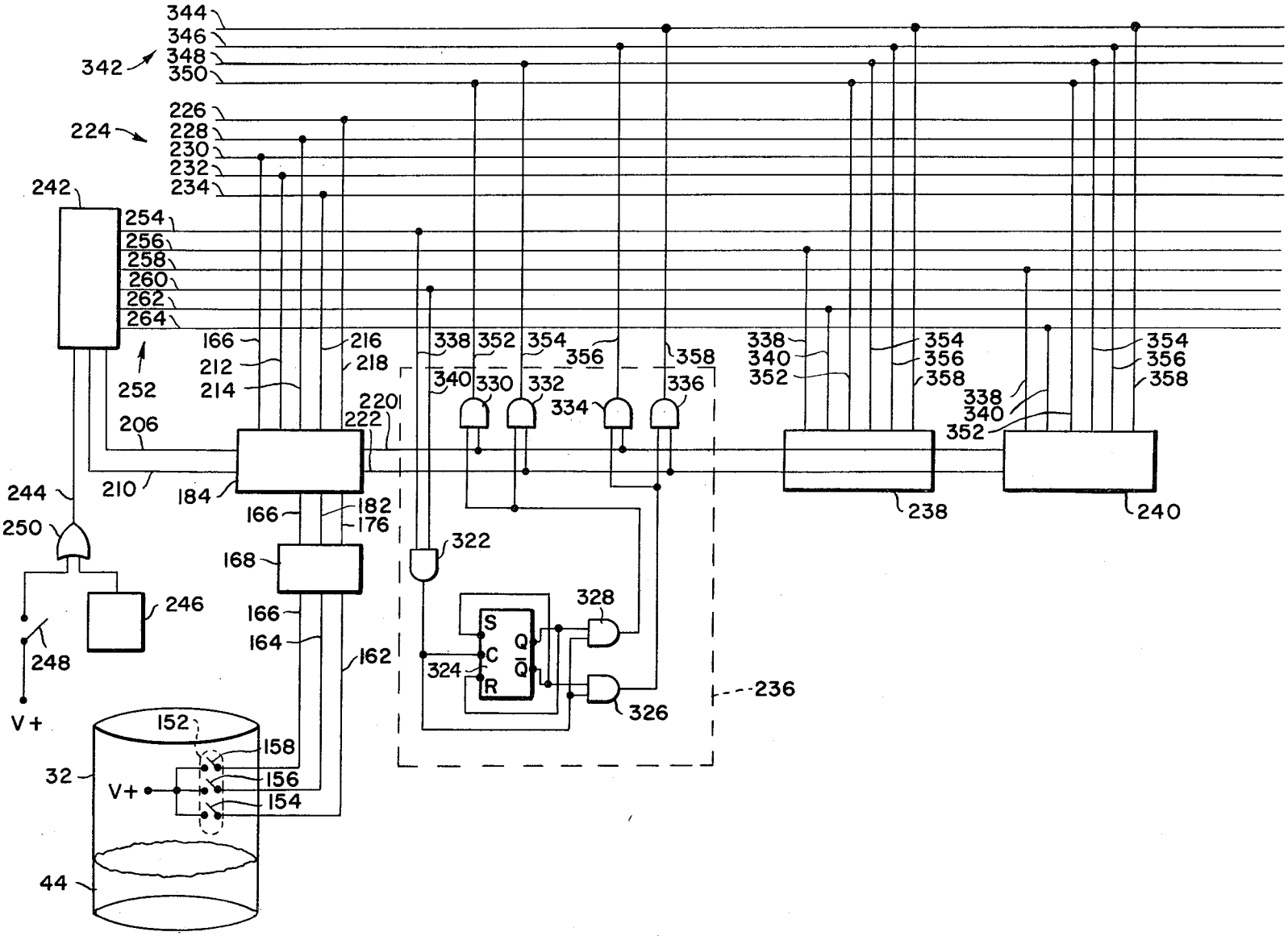
FIG. 16 is a schematic diagram illustrating the construction of an alternator and the connections of the flow control gate selector circuit, mode control circuit, and alternators to the alternator signal bus, mode control signal bus, and flow control gate selector signal bus.

Turning now to FIG. 16, mode control signal bus 224 includes conductors 226, 228, 230, 232, and 234. Conductor 166 is connected to conductor 230, conductor 212 is connected to conductor 232, conductor 214 is connected to conductor 228, conductor 216 is connected to conductor 234, and conductor 218 is connected to conductor 226. In short, the mode signals provided by mode control circuit 184 are emitted to mode control signal bus 224. Conductors 220 and 222 are connected to alternators 236, 238, and 240 in order to provide the alternator input signals to the alternators. Conductors 206 and 210 are connected to flow control gate selector circuit 242 in order to convey the signal/-dual signals emitted by mode control circuit 184. Conductor 244 is also connected to circuit 242 in order to convey the timer signal emitted from timer 246. The nature of this timer signal is illustrated in FIG. 11. Timer 246 emits a pulse at preselected intervals, with intervals ranging from one to twenty minutes generally being peferred when the silo system is employed for cement manufacture. The structure and operation of devices suitable for use as timer 246 is well known in the art. If desired, a manual advance switch 248 may be added to allow an extra pulse to be produced, if desired. If so, an OR gate 250 having an output connected to conductor 244 and inputs connected to switch 248 and timer 246 should be included, as illustrated in FIG. 16. Although switch 248 is shown in FIG. 16 as a simple mechanical switch, in reality it should be de-bounced to provide a single pulse upon each closure. If switch 248 is omitted, timer 246 may be connected directly to conductor 244.

With continuing reference to FIG. 16, flow control gate selector circuit 242 emits flow control gate selection signals to flow control gate selector signal bus 252, which includes conductors 254, 256, 258, 260, 262, and 264. As will be discussed later, these flow control gate selection signals act as circuit-enable signals for the various flow control circuits so as to select which flow control gates are selected for possible activity.

Figure 13:
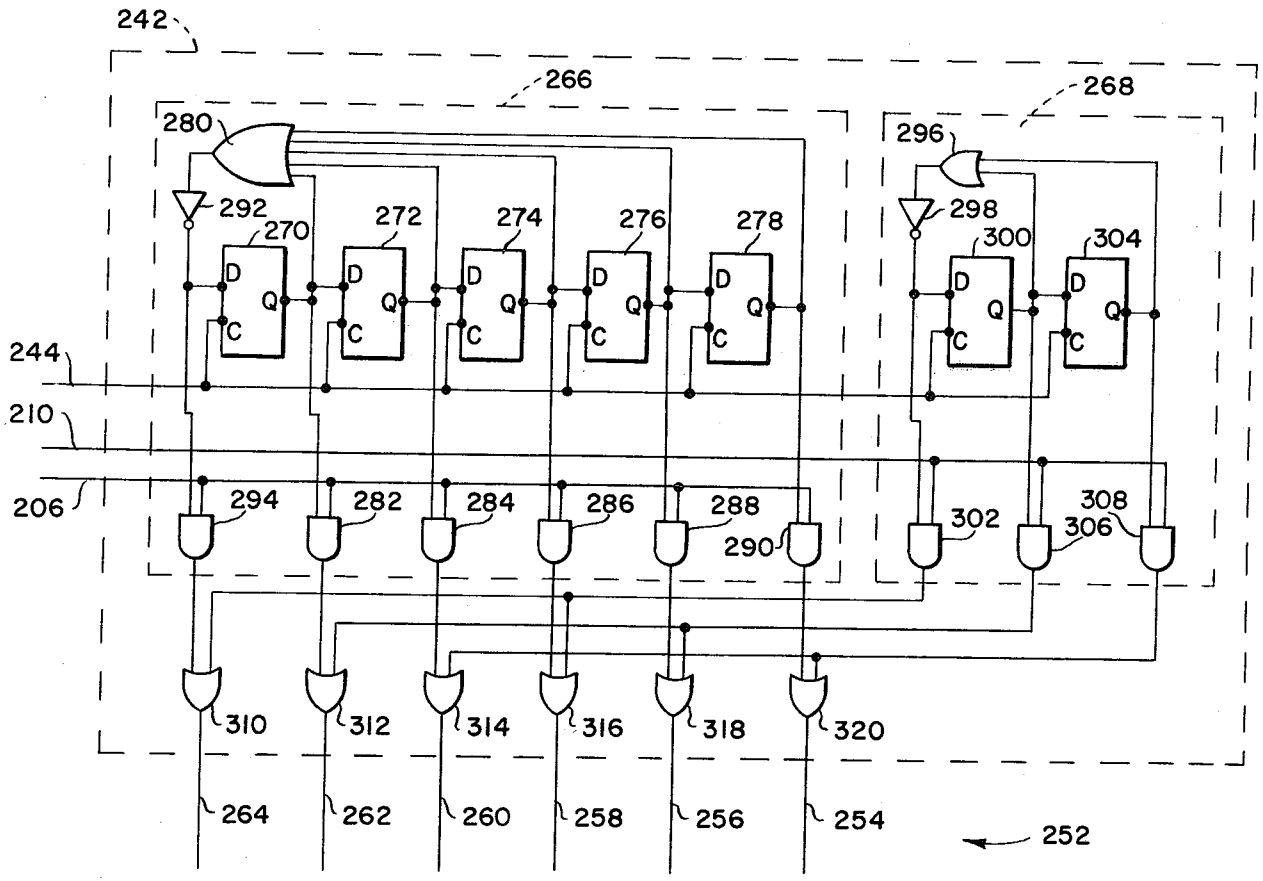
FIG. 13 is a schematic diagram for a flow control gate selector circuit.

Turning now to FIG. 13, flow control gate selector circuit 242 includes a single-flow circuit 266 and a similar but shorter dual-flow circuit 268, each of which receive the timer signal from conductor 244 and the single/dual signals from conductors 206 and 210. Single flow circuit 266 includes five D flip-flops 270, 272, 274, 276, and 278. The Q output of flip-flop 270 is connected to one input of OR gate 280, the D input of flip-flop 272, and one input of AND gate 282. Similarly, the Q output of flip-flop 272 is connected to one input of OR gate 280, the D input of flip-flop 274, and one input of AND gate 284; the Q output of flip-flop 274 is connected to one input of OR gate 280, the D input of flip-flop 276, and one input of AND gate 286; and the Q output of flip-flop 276 is connected one input of OR gate 280, the D input of flip-flop 278, and one input of AND gate 288. The Q output of flip-flop 278 is connected to the last input of OR gate 280 and to one input of AND gate 290. Inverter 292 connects the output of OR gate 280 to the D input of flip-flop 270 and to one input of AND gate 294. Conductor 244 is connected to the clock inputs of each of the flip-flops. It will be apparent to those skilled in the art that, when power has been supplied to circuit 266 and when all of the flip-flops have been cleared so that all of the Q outputs are zero, OR gate 280 will produce an output of zero. Inverter 292 turns ON, supplying a 1 to the D input of flip-flop 270 and to one input of AND gate 294. As is known in the art, D flip-flops function by transferring the signal appearing upon the D input to the Q output upon the transition of the clock input from 0 to 1. Accordingly, when the first pulse from timer 246 appears on conductor 244, the Q output of flip-flop 270 becomes 1, while the Q outputs of flip-flops 272–278 remain 0. OR gate 280 turns ON, thereby turning inverter 292 OFF. When the next pulse arrives on conductor 244 at a preselected time 1–20 minutes later, the Q output of flip-flop 272 turns ON while the Q outputs of the remaining flip-flops are OFF. It will be apparent that the 1 initially provided by inverter 292 is shifted from flip-flop to flip-flop as pulses are generated by the timer until the 1 eventually emerges as the Q output of flip-flop 278. The next incoming pulse turns flip-flop 278 OFF, so that the Q outputs of all of the flip-flops 270–278 are OFF, and inverter 292 turns ON to begin the cycle anew.

With continuing reference to FIG. 13, the operation and construction of dual-flow circuit 268 is similar to that of single-flow circuit 266, except that the cycle includes three rather than six states. The output of OR gate 296 is connected to the input of inverter 298, the output of which is connected to the D input of flip-flop 300 and to one input of AND gate 302. The Q output of flip-flop 300 is connected to one input of OR gate 296, the D input of flip-flop 304, and to one input of AND gate 306. The Q output of flip-flop 304 is connected to the remaining input of OR gate 296 and to one input of AND gate 308. Conductor 244 is connected to the clock input of flip flops 300 and 304. It will be apparent that a 1 will be shifted from inverter 298 to the Q output of flip-flop 300 to the Q output of flip-flop 304 and back to inverter 298 as pulses arrive on conductor 244. It will be recalled that conductor 206 is at a logical high potential when single-flow mode switch 200 is closed, and that conductor 210 is at a logical high potential when either dual-flow-rate mode switch 202 or dual-flow-different-rate mode switch 204 is closed. Accordingly, it will be apparent that AND gates 294, 282, 284, 286, 288, and 290 will be sequentially turned ON under the control of the timer signal for preselected periods ranging from about one to twenty minutes when switch 200 is closed, and AND gates 302, 306, and 308 will be sequentially turned on when either switch 202 or 204 is closed. The outputs of AND gates 294, 282, 284, 286, 288, and 290 are connected to one input of OR gates 310, 312, 314, 316, 318, and 320, respectively. The output of AND gate 302 is connected to the remaining inputs of OR gates 310 and 316, the output of AND gate 306 is connected to the remaining inputs of OR gates 312 and 318, and the output of AND gate 308 is connected to the remaining inputs of OR gates 314 and 320. Accordingly, it will be understood that those skilled in the art that the six conductors 264, 262, 260, 258, 256, and 254 of flow control gates selector signal bus 252 are sequentially turned ON under the control of the timer signal when single-flow mode switch 200 is closed, and pairs of these conductors are sequentially turned ON when either of the dual mode switches 202 or 204 is closed. It will also be understood by those skilled in the art that the circuit 242 which is illustrated in FIG. 13 is not unique. A number of recirculating shift register circuits, steper circuits, counter circuits, or counter-demultiplexer combinations could be used instead. Indeed, a simple six-position rotary switch which is slowly driven by a motor could be used to provide the 1 signals in the single-flow mode and a three-position motor-driven rotary switch could be used for the dual-flow mode. It should also be noted that OR gates 310 through 320 need not be turned ON in the sequence illustrated.

Returning now to FIG. 16, alternator 236 includes AND gate 322 having inputs connected to conductors 254 and 260 and an output connected to the clock input of RS flip-flop 324 and to one input of each of AND gates 326 and 328. AND gate 322 is ON when both of conductors 254 and 260 are ON, so it is apparent that AND gate 322 is OFF if single-flow mode switch 200 has been depressed. If either of dual-flow mode switches 202 or 204 has been depressed, AND gate 322 will be ON for one period ranging from one to twenty minutes when conductor pair 254 and 260 are ON, and OFF for two periods of one to twenty minutes when conductor pair 256 and 262 and conductor pair 258 and 264 are ON. Flip-flop 324 is connected in toggle configuration, with the set input connected to the Q' output and with the reset input connected to the Q output. In this configuration, it will be understood by those skilled in the art that the Q and Q' outputs change state each time AND gate 322 turns ON, the Q output turning ON the first time AND gate 322 turns ON, and the Q' output turning ON the next time. The Q and Q' outputs are connected to the remaining inputs of AND gates 328 and 326, respectively, so that AND gate 328 and 362 alternately turn ON when AND gate 322 turns ON. The output of AND gate 328 is connected to one input of AND gates 330 and 332, the remaining inputs of which receive the alternator input signals from conductors 220 and 222, respectively, when dual-flow-different rate mode switch 204 is closed. Similarly, one input of AND gates 334 and 336 is connected to the output of AND gate 326, and the other inputs receive alternator input signals from conductors 220 and 222, respectively, when switch 204 is closed. Accordingly, AND gates 330 and 332 are allowed to turn ON for a period ranging from 1 to 20 minutes, depending upon the alternator input signals then present on conductors 220 and 222. Two to forty minutes later, AND gates 334 and 336 are allowed to turn ON. Conductors 338 and 340 connect the inputs of AND gates 322 to conductors 254 and 260, respectively. Alternator signal bus 342 includes conductors 344, 346, 348, and 350. The outputs of AND gates 330, 332, 334, and 346 are connected to conductors 350, 348, 346, and 344, respectively, by conductors 352, 354, 356, and 358. The construction of alternators 238 and 240 is the same as the construction of alternator 236. It will be noted that conductors 352, 354, 356, and 358 of alternators 238 and 240 are connected to alternator signal bus 342 in the same way that the corresponding leads of alternator 236 are connected. It will also be noted, however, that conductors 338 and 340 of alternators 238 and 240 are connected to flow control gates selector signal bus in different ways. Conductors 338 and 340 of alternator 238 are connected to conductors 256 and 262, while conductors 338 and 340 of alternator 240 are connected to conductors 258 and 264. Although the connections to bus 342 are illustrated as wired-OR connections, OR gates could be used if desired. For example, the AND gates 330 of the three alternators 236, 238, and 240 could be connected to conductor 350 by using a three-input OR gate. It will be apparent to those skilled in the art that alternators 236, 238, and 240 are cyclically enabled for periods ranging from one to twenty minutes. On one cycle the AND gates 330 and 332 of alternator 236 would be enabled for a period ranging from one to twenty minutes, then the AND gates 330 and 332 of alternator 238 would be enabled for a similar period, followed by AND gates 330 and 332 of alternator 240. During the next cycle, AND gates 334 and 336 of alternator 236 would be enabled, followed by the AND gates 334 and 336 of alternators 238 and 240. Whether these AND gates will actually be turned ON, of course, depends upon whether the alternator input signals are one or zero, which ultimately depends upon the level indicator signals emitted by level indicator circuit 168.

Figure 7:
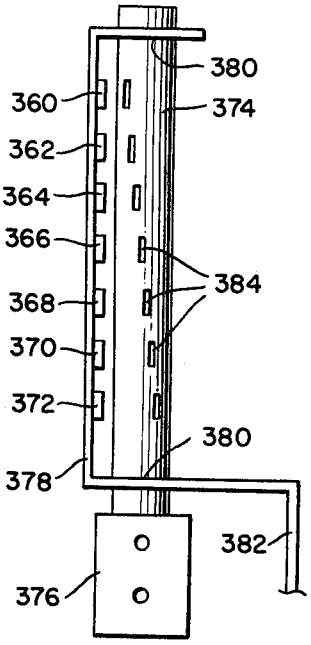
FIG. 7 is a side view of a limit switch assembly for providing flow control gate position signals.
Figure 17:
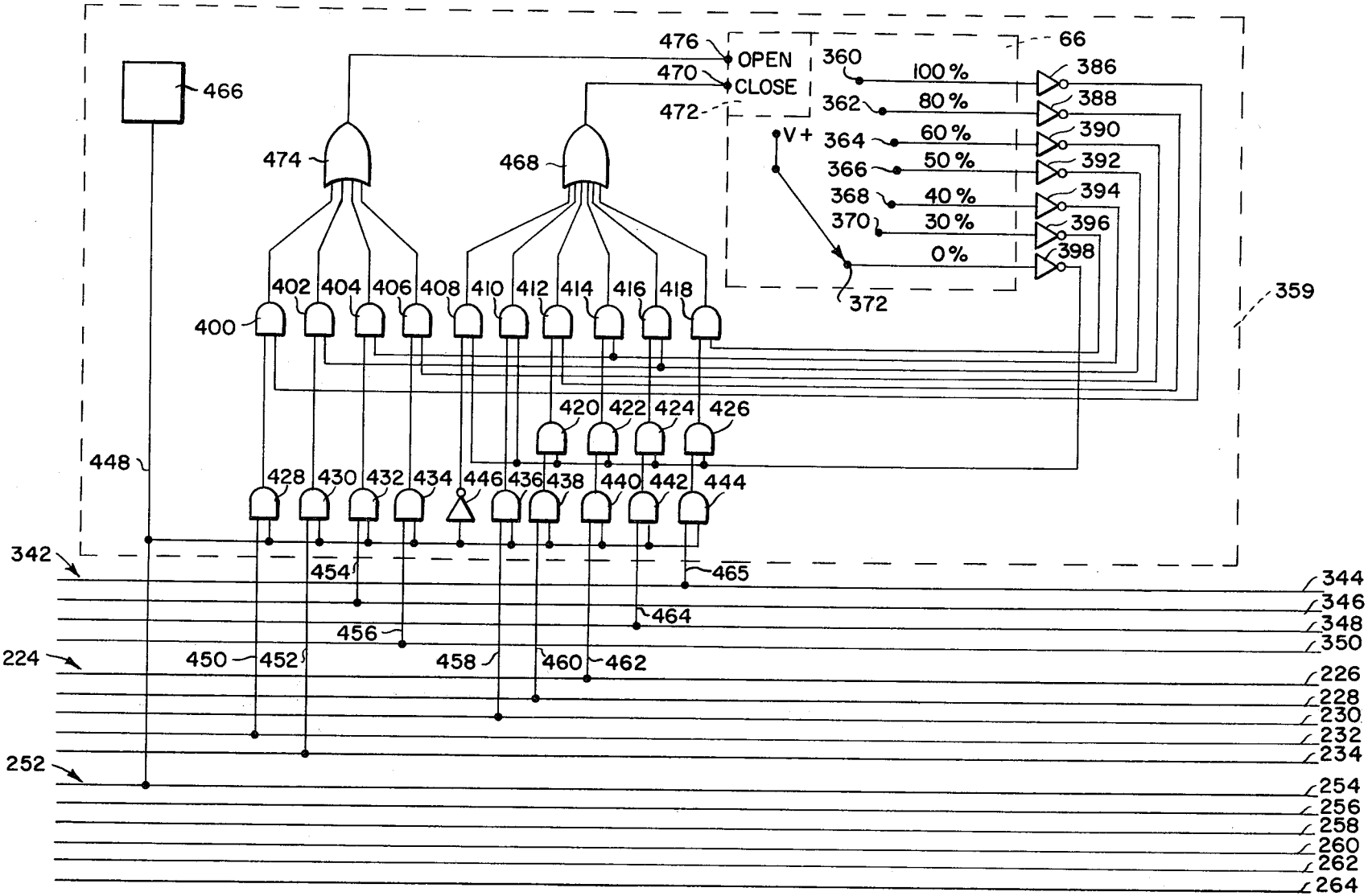
FIG. 17 is a schematic diagram of a flow control circuit.

Turning next to FIGS. 7 and 17, each of the flow control gates 66 includes a position indicator system. FIG. 17 illustrates a flow control circuit 359 which has seven limit switches 360, 362, 364, 366, 368, 370, and 372 which close when the flow control gate 66 is opened 100%, 80%, 60%, 50%, 40%, 30%, and 0%, respectively. In FIG. 7, cylinder 374 has a coupling 376 for connection to shaft 134 of cylinder 128. Limit switches 360–372 are attached at spaced-apart positions on mounting bracket 378, which is provided with openings 380 for loosely accommodating cylinder 374 and with mounting flange 382 which allows bracket 378 to be mounted on top portion 126 of flow control gate 66. Seven abutments 384 protrude from cylinder 374 in a spiral pattern so as to close the limit switches 360 through 372 depending upon the angular orientation of flow control gate cylinder 128. It will be apparent to those skilled in the art that there are a number of alternative ways for mounting limit switches or rotary switches to provide position signals. Optical or magnetic sensors could also be used. A useful method for generating position signals without the use of switches will be discussed later in this specification.

With continuing reference to the flow control circuit 359 of FIG. 17, the input of inverter 386 is connected to limit switch 360 so that inverter 386 is OFF when limit switch 360 is closed. Similarly, the inputs of inverters 388, 390, 392, 394, 396, and 398 are connected to limit switch 362, 364, 366, 368, 370, and 372, respectively. The output of inverter 398 is connected to one of the inputs of AND gates 408, 410, 420, 422, 424, and 426. The remaining inputs of these AND gates are connected, respectively, to the output of inverter 446 and to the outputs of AND gates 436, 440, 442, and 444. The output of inverter 396 is connected to one input of AND gate 418, the other input of which is connected to the output of AND gate 426. The output of inverter 394 is connected to one input of AND gates 404 and 414. The second input of these AND gates are connected to the output of AND gates 432 and 422, respectively. The output of inverter 392 is connected to one of the inputs of AND gates 402 and 416. The second inputs of these AND gates are connected to the outputs of AND gates 430 and 424, respectively. The output of inverter 390 is connected to one of the inputs of AND gate 406, and the second input of this AND gate is connected to the output of AND gate 434. The output of inverter 388 is connected to one of the inputs of AND gate 412, the remaining input of this AND gate being connected to the output of AND gate 420. The output of inverter 386 is connected to one of the inputs of AND gate 400, with the remaining input of this AND gate being connected to the output of AND gate 428. The outputs of AND gates 438, 440, 442, and 444 are connected to one of the inputs of AND gates 420, 422, 424, and 426, respectively. The input of inverter 446 and one of the inputs of AND gates 428, 430, 432, 434, 436, 438, 440, 442, and 444 are connected to conductor 448. For reasons to be discussed later conductor 448 may be deemed the "circuit-enable" input for flow control circuit, or more simply, just the "enable" conductor. The remaining input of AND gate 428 is connected via conductor 450 to conductor 232; the remaining input of AND gate 430 is connected via conductor 452 to conductor 234; the remaining input of AND gate 432 is connected via conductor 454 to conductor 346; the remaining input of AND gate 434 is connected via conductor 456 to conductor 350; the remaining input of AND gate 436 is connected via conductor 458 to conductor 230; the remaining input of AND gate 438 is connected via conductor 460 to conductor 228; the remaining input of AND gate 440 is connected via conductor 462 to conductor 226; the remaining input of AND gate 442 is connected via conductor 464 to conductor 348; and the remaining input of AND gate 444 is connected via conductor 465 to conductor 344. Enablement conductor 448 connects sector air control valve activator 466 to conductor 254. If desired, however, activator 466 may be connected to the output of inverter 398 in order to conserve air during periods when flow control circuit 359 is enabled by the flow control gate selector signal but flow control gate 66 is closed.

With continuing reference to FIG. 17, the six inputs of OR gate 468 are connected to the outputs of AND gates 408, 410, 412, 414, 416, and 418, respectively. The output of OR gate 468 is connected to "close" terminal 470 of motor circuit 472. The four inputs of OR gate 474 are connected to the outputs of AND gates 400, 402, 404, and 406, respectively. The output of OR gate 474 is connected to "open" terminal 476. When OR gate 474 is ON motor 146 will be activated to open flow control gate 66 to a greater extent. Conversely, when OR gate 468 is ON motor 146 will be activated to begin closing the flow control gate 66.

It will be noted that inverter 446 is turned ON when conductor 254 is at 0 potential, thereby turning AND gate 408 ON unless zero percent limit switch 372 is closed. Accordingly, OR gate 468 will be turned ON to close flow control gate 66 if it should be opened when flow control gate selector circuit 242 returns conductor 254 to a logical low potential. When a logical high potential appears on conductor 254, however, selector air control valve 88 is opened and AND gates 428 through 444 are enabled. In short, flow control gate selector circuit 242 selects a flow control gate 66 by emitting a flow control gate selector signal of potential 1 to the enablement conductor 448 of the selected flow control circuit. Assuming that flow control gate selector circuit 242 has selected the flow control circuit 359 illustrated, the operation of flow control gate 66 will depend jointly upon the angular position of cylinder 128 and upon the signals on alternator signal bus 342 and flow control gate selector signal bus 224. When the potential on conductor 254 is 1, it will be apparent to those skilled in the art that OR gate 474 will be ON when the potential on conductor 232 is 1 and inverter 386 is ON, or when the potential on conductor 234 is 1 and inverter 392 is ON, or when the potential on conductor 346 is 1 and inverter 394 is ON, or when the potential on conductor 350 is 1 and inverter 390 is ON. Similarly, when the potential on conductor 254 is 1, OR gate 468 will be ON when the potential on conductor 230 is 1 and inverter 398 is ON, or when the potential on conductor 228 is 1 and inverter 398 is ON and inverter 388 is ON, or when the potential on conductor 226 is 1 and inverter 398 is ON and inverter 394 is ON, or when the potential on conductor 348 is 1 and inverter 398 is ON and inverter 392 is ON, or when the potential on conductor 344 is 1 and inverter 398 is ON and inverter 396 is ON. With reference to FIG. 16, it will be recalled that the conductors of alternator signal 342 are connected to AND gate pairs in alternator 236 which are alternately enabled during the dual-flow-different rate mode. These periods of alternate enablement may be deemed "period A" and "period B" for purposes of description.

With reference to FIGS. 14, 16, and 17, it will be recalled that the potential on conductor 344 is the same as the potential on conductor 182 during period A when switch 204 is closed; otherwise it is 0. The potential on conductor 346 is the same as the potential on conductor 176 during period A when switch 204 is closed, otherwise it is zero. The potential on conductor 348 is the same as the potential on conductor 182 during period B when switch 204 is closed, otherwise it is 0. The potential on conductor 350 is the same as the potential on conductor 176 during period B when switch 204 is closed, otherwise it is 0. The potential on conductor 226 is the same as the potential on conductor 182 when switch 202 is closed, otherwise it is 0. The potential on conductor 228 is the same as the potential on conductor 182 when switch 200 is closed, otherwise it is 0. The potential on conductor 230 is the same as the potential on conductor 166, regardless of which of switches 200, 202, or 204 is closed. The potential on conductor 232 is the same as the potential on conductor 176 when switch 200 is closed, otherwise it is 0. The potential on conductor 234 is the same as the potential on conductor 176 when switch 202 is closed, otherwise it is 0. Inverter 386 is ON except when flow control gate 66 is open 100%, so that switch 360 is closed. Similarly, inverters 388, 390, 392, 394, 396, and 398 are ON except when flow control gate 66 is opened 80%, 60%, 50%, 40%, 30%, and 0%, respectively. These results for flow control circuit 359 are summarized in Table 1 below, where "P166" represents the potential of the level indicator signal on conductor 166, "P182" represents the potential of the level indicator signal on conductor 182, and "176" represents the potential of the level indicator signal on conductor 176.

TABLE 1

| | (flow control circuit 359 enabled) | | | |
|---|---|---|---|---|
| | Mode switch closed: | Level indicator signal: | Flow control gate opening: | Alternator period: |
| | | OR gate 474 ON: | | |
| (A) | 200 | P176 = 1 | not 100% | n/a |
| (B) | 202 | P176 = 1 | not 50% | n/a |
| (C) | 204 | P176 = 1 | not 40% | A |
| (D) | 204 | P176 = 1 | not 60% | B |
| | | OR gate 468 ON: | | |
| (E) | any | P166 = 1 | not 0% | n/a |
| (F) | 200 | P182 = 1 | not 0% and not 80% | n/a |
| (G) | 202 | P182 = 1 | not 0% and not 40% | n/a |
| (H) | 204 | P182 = 1 | not 0% and not 50% | B |
| (I) | 204 | P182 = 1 | not 0% and not 30% | A |

It should be observed from Table 1 that OR gates 468 and 474 cannot be on simultaneously, since the potential on conductor 182 is the inverse of potential on conductor 176 and since the potential on conductor 176 is always zero when the potential ON conductor 166 is one.

With Table 1 in mind, it would be useful to consider several examples of the operation of the flow control circuit 359 illustrated in FIG. 17. Assume that initially the level of material 44 is as illustrated in FIG. 14, that single-flow mode switch 200 has been closed, that the potential on conductor 254 has just become 1, and that flow control gate 66 is entirely closed. Valve actuator 466 opens sector air control valve 88 when the potential on conductor 254 becomes 1, and air is delivered to the aeration elements 58 in the sector 60 corresponding to the flow control gate 66. FIGS. 15 indicate that P176=1, P182=0, and P166=0. Entry (A) of Table 1 indicates that OR gate 474 will turn ON. Flow control gate 66 begins to open, and this opening movement continues until it is open 100%. Material 44 cascades into homogenizing silo 32, and the level begins to rise. FIG. 15(*a*) illustrates that the level indicator signals do not change as bottom level switch 154 is traversed, so flow control gate 66 remains open 100%. When medium level switch 156 is traversed, however, P176 falls to 0 and P182 rises to 1. Entry (F) indicates that OR gate 468 turns ON, and flow control gate 66 closes until the 80% position is attained (the 0% notations in Table 1 ensure that there will be no attempt to close flow control gate 66 when it is already entirely closed). Material 44 continues to enter homogenizing silo 32, but at a reduced rate. Finally, top level switch 152 is traversed. FIGS. 15 illustrate that P166 becomes 1, so that OR gate 468 turns ON. Flow control gate 66 closes until it reaches the 0% position or entirely closed. After flow control gate 66 has been moved downward from the 80% position, entry (F) also indicates a closing motion. Assume now that material 44 is rapidly removed from homogenizing silo 32, and that the level begins to fall. The potential on conductor 166 drops to zero as top level switch 158 is traversed, but the other level indicator signals remain unchanged as indicated in FIGS. 15. As the level of material 44 continues to fall, medium level switch 156 is traversed. FIG. 15(*b*) illustrates that the level indicator signals remain unchanged. Finally, bottom level switch 154 is traversed, and P182 falls to 0 while P176 rises to 1. Entry (A) in Table 1 indicates that OR gate 474 turns ON and flow control gate 66 opens 100%. When the material removal stops, the level will begin to rise again towards to top of homogenizing silo 32. In the event that the potential on conductor 254 becomes zero while flow control gate 66 is open, inverter 446, gate 408, and OR gate 468 will turn ON until flow control gate 466 is closed.

Assume next that the level of material 44 in homogenizing silo 32 is as illustrated in FIG. 14, that dual-flow-equal-rate mode switch 202 has been closed, that the two flow control gates 66 corresponding to conductors 254 and 260 are initially closed, and that the potential on conductor 254 has just become 1. Entry (B) of Table 1 indicates that both flow control gates 66 will open 50% (each thereby contributing half of the flow achieved by a single flow control gate in the single-flow mode). When material 44 rises past medium level switch 156, entry (G) of Table 1 indicates that OR gate 468 will turn ON until the flow control gates 66 close to the 40% position. Material 44 continues rising at a reduced rate until top level switch 152 is traversed, whereupon P166 becomes 1. Entry (E) of Table 1 indicates that both flow control gates 66 will be closed. Entry (B) of FIG. 1 indicates that both flow control gates 66 will remain closed until the level of material 44 subsequently falls past bottom level switch 154.

Consider next the situation wherein the level of material 44 is intially as illustrated in FIG. 14, dual-flow-different-rate mode switch 204 is depressed, the alternator period is period A, the flow control gate 66 is closed entirely, and the potential on conductor 254 has just become 1. The operation of the other flow control gate simultaneously activated by conductor 260 will be momentarily disregarded. Entry (C) of Table 1 indicates that OR gate 474 will be ON until the 40% position is achieved. When the level of material 44 rises past the medium level switch 156, FIG. 15(*a*) illustrates that P182 rises to 1 and P176 falls to 0. Entry (I) of Table 1 indicates that the flow control gate will close to the 30% position. When material rises to top level switch 158, FIGS. 15 indicate that the potential on conductor 166 rises to 1, while the other two level indicator signals remain unchanged. Entry (E) of Table 1 indicates that OR gate 468 will turn ON until the 0% position is achieved. When material is thereafter removed so that the level of material 44 falls, FIGS. 15 indicate that P166 becomes zero as top level switch 152 is uncovered, while P182 remains 1, and P176 remains 0. These level indicator signals remain unchanged as medium level switch 156 is traversed, as is illustrated in FIG. 15(*b*). When bottom level switch 154 is traversed, however, FIG. 15(*b*) indicates that P182 falls to 0 and P176 rises to 1. Entry (C) of Table 1 indicates that the flow control gate will open again to the 40% position. It will remain open to this degree until the material again rises past medium level switch 156, at which point the flow control gate will close to the 30% position. When the potential on conductor 254 becomes 0, inverter 446, inverter 398, AND gate 408, and OR gate 468 will ensure that the flow control gate is closed. The next time conductor 254 becomes 1, alternator 236 will select the period B. Assuming again that the level of material 44 initially is as illustrated in FIG. 14, FIGS. 15 indicates that P176=1, P182=0, and P166=0. Entry (D) of Table 1 indicates that OR gate 474 will be turned ON to energize the flow control gate until it achieves the 60% position. FIG. 15(*a*) indicates that the level indicator signals remain unchanged as bottom level switch 154 is traversed, but P176 falls to 0 and P182 rises to 1 when medium level switch 156 is traversed. Entry (H) of Table 1 indicates that OR gate 468 will turn ON until the flow control gate closes from 60% to 50%. Homogenizing silo 32 continues to fill at a slower rate until top level switch 152 is traversed, at which point P166 rises to 1. Entry (E) of Table 1 indicates that OR gate 468 will turn ON until the flow control gate is closed to the 0% position. When material is withdrawn, P166 falls to 0 when top level switch 152 is uncovered, but P182 will remain 1 and P176 will remain 0. FIG. 15(*b*) indicates that P182 and P176 will remain unchanged until bottom level switch 154 is traversed, at which point entry (D) of Table 1 indicates that OR gate 474 will be turned ON to open the flow control gate to the 60% position.

Figure 18:
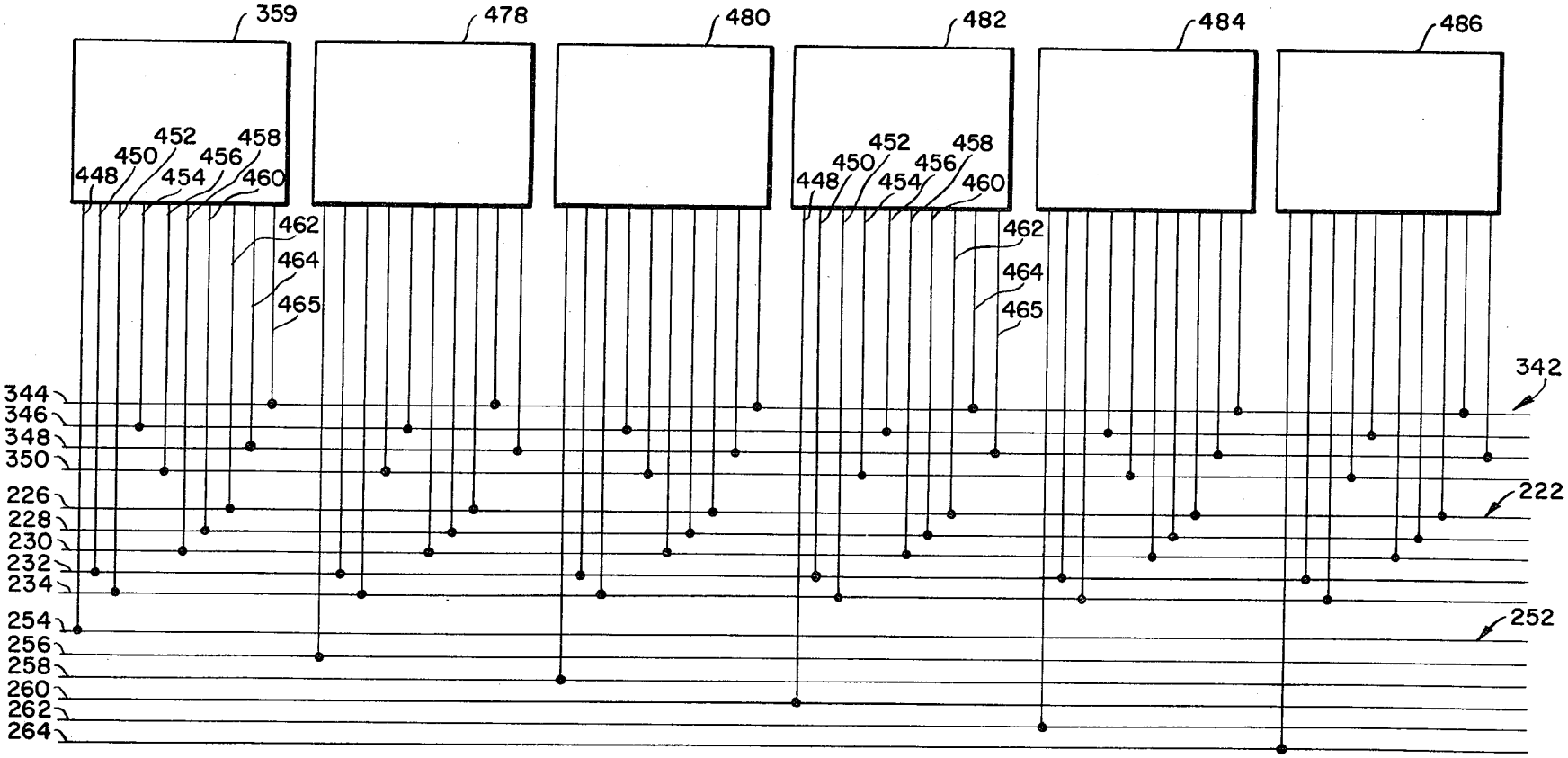
FIG. 18 is a schematic daigram illustrating how the six flow control circuits are connected to the alternator signal bus, mode control signal bus, and flow control gate selector signal bus.

Turning now to FIG. 18, the construction of the remaining five flow control circuits 478, 480, 482, 484, and 486 is the same as the construction of flow control circuit 359 illustrated in FIG. 17. It will be noted that the conductor 448 of each of the flow control gates is connected to a different conductor of flow control gate selector signal bus 252. The connections to mode control signal bus 224 are the same for all of the flow control circuits. However, only the flow control circuits 480 and 484 are connected to alternator signal bus 342 in the same way that flow control circuit 359 is connected. For flow control circuits 478, 482, and 486, conductor 454 is connected to conductor 350 instead of conductor 346; conductor 456 is connected to conductor 346 instead of conductor 450; conductor 464 is connected to conductor 344 instead of to conductor 348; and conductor 465 is connected to conductor 348 instead of to conductor 344. In short, the connections to alternator signal bus 342 for flow control circuits 359, 480, and 484 are the reverse of the connections for flow control circuits 478, 482, and 486. It will be apparent to those skilled in the art that Table 2 below describes the operation of flow control circuits 478, 482, and 486.

TABLE 2

| | Mode switch closed: | (flow control circuit 482 enabled) Level indicator signal: | Flow control gate opening | Alternator period: |
|---|---|---|---|---|
| | | OR gate 474 ON: | | |
| (A') | 200 | P176 = 1 | not 100% | n/a |
| (B') | 202 | P176 = 1 | not 50% | n/a |
| (C') | 204 | P176 = 1 | not 40% | B |
| (D') | 204 | P176 = 1 | not 60% | A |
| | | OR gate 468 ON: | | |
| (E') | any | P166 = 1 | not 0% | n/a |
| (F') | 200 | P182 = 1 | not 0% and not 80% | n/a |
| (G') | 202 | P182 = 1 | not 0% and not 40% | n/a |
| (H') | 204 | P182 = 1 | not 0% and not 50% | A |
| (I') | 204 | P182 = 1 | not 0% and not 30% | B |

It is apparent from inspection of Table 2 that operation of all of the flow control circuits is the same for the single-flow mode and for the dual-flow-equal-rate mode. In the dual-flow-different-rate mode, however, the operation is changed. For example, it will be noted from FIG. 16 that flow control circuit 482 will be activated along with flow control circuit 359 when dual-flow-different-rate mode switch 204 is closed. For example, assume that the level material 44 is initially as illustrated in FIG. 14, that the flow control gates 66 of flow control circuits 359 and 482 are closed entirely, and that alternator 236 selects period A when the potential on conductors 254 and 260 becomes 1. FIG. 15 indicate that P176=1, P182=0, and P166=0. Entry (D') of Table 2 illustrates that OR gate 474 of flow control circuit 482 will be turned ON until the flow control gate 66 achieves the 60% position. Homogenizing silo 32 will fill until medium level switch 156 is covered, at which point FIG. 15(*a*) indicates that the potential on conductor 176 falls to 0 and the potential on conductor 182 rises to 1, whereupon entry (H') of Table 2 indicates that the flow control gate will close to the 50% position. When top level switch 152 is finally covered, FIG. 15 indicate that P166 rises to 1. Entry (E') of Table 2 indicates that the flow control gate will close entirely. If material 44 is thereafter removed from homogenizing silo 32, FIG. 15(*b*) indicates that P176 does not become 1 until switch 176 is traversed, whereupon entry (D') of Table 2 indicates that the flow control gate opens to 60% again. The next time flow control gate selector circuit 242 raises the potential of conductors 254 and 260 to 1, alternator 168 selects the B period. Assuming again that the level of material 44 is as illustrated in FIG. 14, entry (C') of Table 2 indicates that the flow control gate 66 of flow control circuit 482 will open to the 40% position. FIG. 15(*a*) indicates that the potential of conductor 182 changes to 1 as rising material covers switch 156, at which point entry (I') of Table II indicates that the flow control gate 66 of flow control circuit 482 will close to the 30% position. This position is maintained until top level switch 152 is covered, whereupon P166 becomes 1, and entry (E') of Table II indicates that the flow control gate will be closed. It will remain closed when material is removed from silo 32 as the material level falls past medium level switch 156. When bottom level switch 154 is uncovered, however, FIG. 15(*b*) indicates that the potential on conductor 176 rises to 1. Entry (D') indicates that the flow control gate will thereupon again be opened to the 40% position.

It will be noted from the preceding discussion that, in the dual-flow-equal-rate mode, one of the flow control gates will be open to the 60% position and the other will be opened to the 50% position until the level of material 44 rises to cover medium level switch 156. The flow control gates are then reduced to the 50% and 40% positions until top level switch 158 is covered. Both flow control gates remain closed until the level of material 44 falls past bottom level switch 154, whereupon they are again opened to the 60% and 50% positions. In short, one of the flow control gate opens 10% wider than the other when material 44 flows into homogenizing silo 32. It will be apparent from Tables I and II that the flow control gates reverse roles during the next alternator period. That is, the flow control gate which originally opened to 60% and then to 50% during alternator period A opens to 50% and then 40% during alternator period B, and the flow control gate which opens to 50% and then 40% during alternator period A opens to 60% and then 50% during alternator period B. In short, the 10% additional material flow is shifted from one of the flow control gate pair to the other each time the pair is activated.

Although the initial level of material 44 was below bottom level switch 154 in the preceding examples when the flow control circuits were enabled, it will be apparent to those skilled in the art that this is not a necessary precondition. For example, assume that single-flow mode switch 200 is closed, that the flow control gate 66 of flow control circuit 359 illustrated in FIG. 17 is initially closed, and that the level of material 44 is falling from top level switch 158 towards medium level switch 156 when the potential on conductor 254 becomes 1. FIG. 15 indicate that the potential on conductors 166 and 176 is 0 while the potential on conductor 182 is 1. Entry (F) of Table 1 indicates that the flow control gate will remain closed. When the material level falls past level switch 154, however, FIG. 15(*b*) indicates that P176 rises to 1 and P182 falls to 0. Entry (A) of Table 1 indicates that OR gate 474 turns ON, and remains ON until the flow control gate is opened 100%. This is the same result achieved with the previous example illustrating the single-flow mode period. In short, the fill and empty operations proceed in the manner discussed regardless of the level of material 44 when timer 246 generates a pulse.

Figure 12:
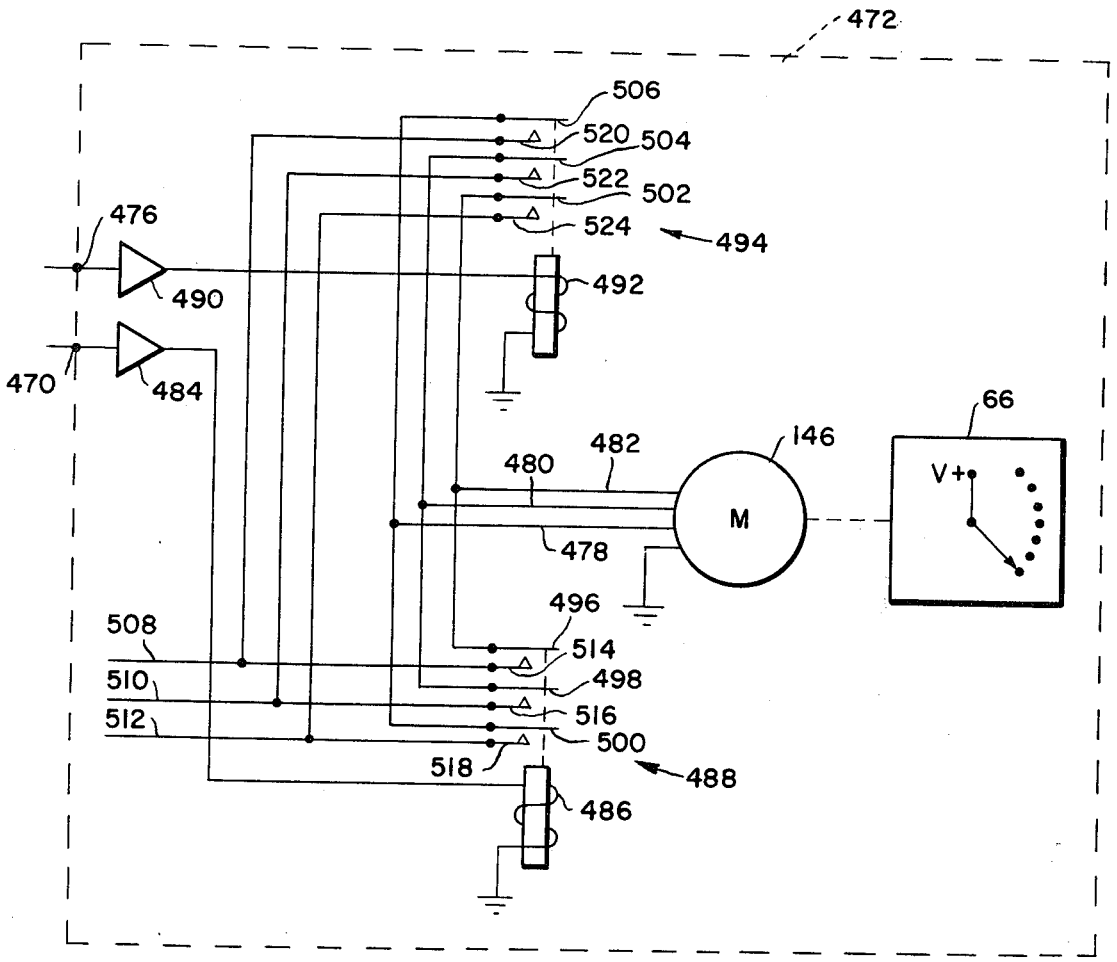
FIG. 12 is a schematic diagram illustrating a circuit for reversing the rotation of a three phase motor for operating a flow control gate.

Turning next to FIG. 12, it is apparent that a method is needed for reversing motor 146 depending upon the potential on terminals 470 and 476. It will be apparent to those skilled in the art that a simple DC motor can be used, with suitable relays or input buffers driven by gates 474 or 468 to provide the necessary power. However, AC motors are commercially available which are not destroyed if power is applied to the windings while the motor is stalled. This is a desirable feature in cement manufacture, since a flow control gate is ocassionally jammed open by a foreign object. The motor 146 illustrated in FIG. 12 is a three phase AC motor which has conductors 478, 480, and 482 for receiving power. Buffer 484 has an input connected to terminal 470 and an output connected to one end of coil 486 of relay 488, the other end of coil 486 being grounded. Buffer 484 is ON when OR gate 468 is ON and OFF when OR gate 468 is OFF, but provides the necessary power for activating relay 488. The input of buffer 490 is connected to terminal 476 and the output is connected to one end of coil 492 of relay 494, the remaining end of coil 492 being grounded. Movable contacts 496, 498, and 500 of relay 488 are electrically connected to movable contacts 502, 504, and 506 of relay 494, respectively, and to conductors 482, 480, and 478 of motor 146, respectively. Power input conductors 508, 510, and 512 are electrically connected to fixed contacts 514, 516, and 518 of relay 488 and to fixed contacts 520, 522, and 524 of relay 494, respectively. It will be apparent that when buffers 484 and 490 are both OFF, motor 146 is not energized. When buffer 484 is ON, coil 486 will be energized and bend contact 496 against contact 514, contact 498 against contact 516, and contact 500 against contact 518, thereby connecting conductor 508 and conductor 482, conductor 510 and conductor 480, and conductor 512 and conductor 478. Motor 146 will rotate to move flow control gate 66 toward the closed position. When buffer 490 is ON, however, it will be apparent that coil 492 will be energized to bend contact 506 against contact 520, contact 504 against contact 522, and contact 502 against contact 524, thereby electrically connecting conductor 508 to conductor 478, conductor 510 to conductor 480, and conductor 512 to conductor 482. Motor 146 will rotate to open flow control gate 66 wider.

The use of limit switches to provide flow control gate position indicating signals has already been discussed. The circuit illustrated in FIG. 19, however, provides the alternative of generating position indicating signals without the use of switches. One advantage of the circuit of FIG. 19 is that the angular position at which the signals appear can easily be adjusted at remote locations.

Ganged potentiometer 526 having first portion 528 is provided with a shaft (not illustrated) which is coupled to shaft 134 extending from flow control gate cylinder 128 in lieu of a limit switch assembly such as the one illustrated in FIG. 7. One end of second portion 530 is grounded while the other end is connected through resistor 532 to a power source of potential 1. One end of resistor 534 is connected to the power source and the other end is connected through resistor 536 to one end of first portion 528, the other end of which is grounded. It will be apparent that two voltage dividers are formed, and that if resistors 534 and 532 are equal in value, the potential at movable contact 538 of first portion 528 is less than the potential at movable contact 540 of second portion 530, regardless of the angular orientation of the flow control gate. The value of resistor 536 may be varied to reduce this difference to as small a value as desired.

Figure 19:
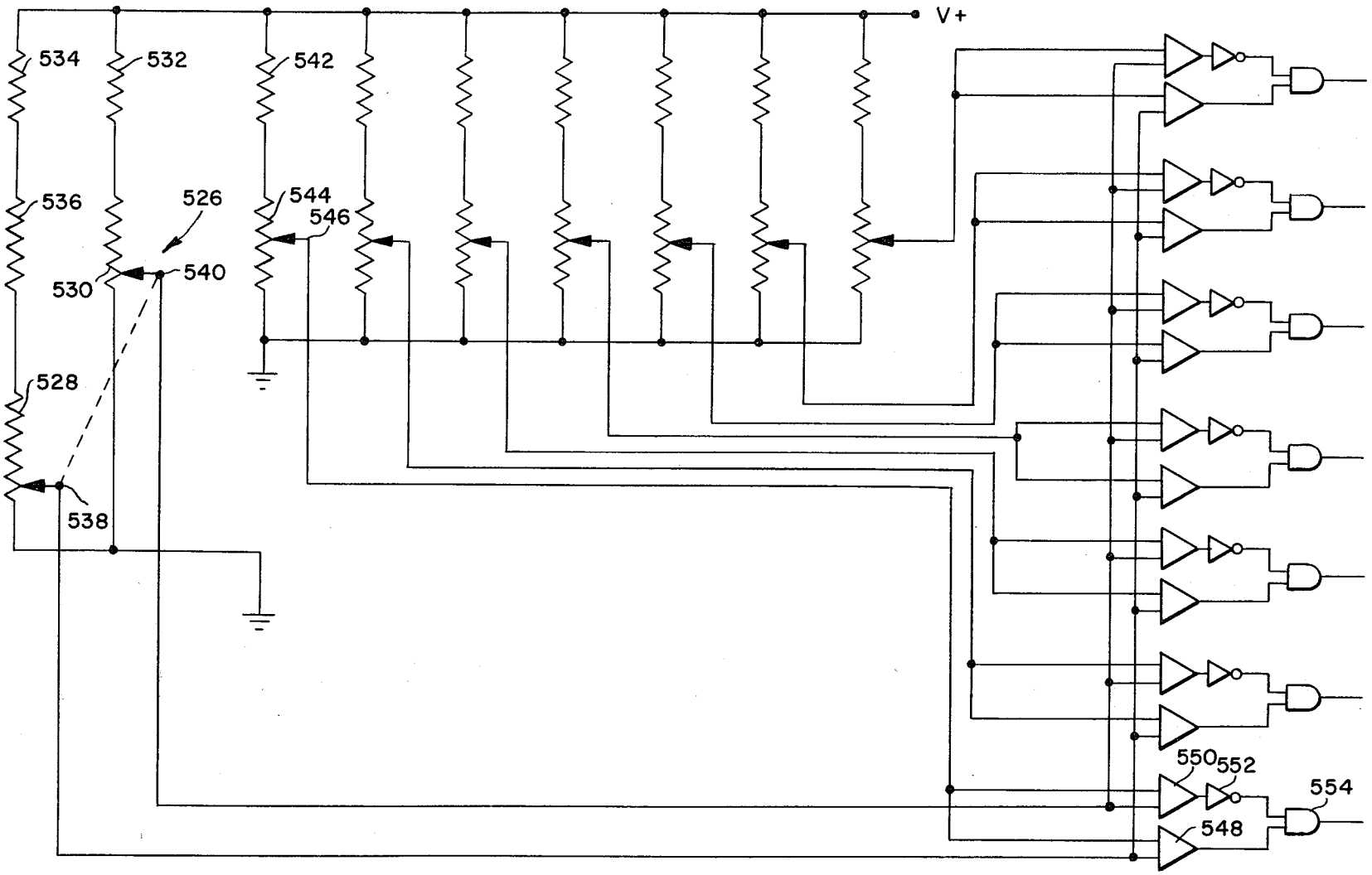
FIG. 19 is a schematic diagram illustrating a circuit for generating flow control gate position signals without the use of limit switches.

With continuing reference to FIG. 19, resistor 542 and potentiometer 544 are also series-connected between the power source and ground to provide a voltage divider, with the output voltage depending upon the position of movable contact 546. Comparator 548 has one input connected to movable contact 538 and the other input connected to movable contact 546, while comparator 550 has one input connected to movable contact 540 and the other input connected to movable contact 546. The output of comparator 550 is connected through inverter 552 to one input of AND gate 554, the other input of which is connected to the output of comparator 548. It will be apparent to those skilled in the art that comparator 548 compares the potential at movable contacts 538 and 546, while comparator 550 compares the potential at movable contacts 540 and 546. AND gate 554 will be ON only when comparator 548 is ON and comparator 550 is OFF, so that a flow control gate position indicator signal is generated by AND gate 554 for a narrow range of angular positions of cylinder 128. Potentiometer 544 may be positioned at a conviently located panel, so that the flow control gate position indicator signals may thereby be adjusted as desired. That is, the percentage openings illustrated in FIG. 17 may easily be changed to other values. The remainder of the circuit illustrated in FIG. 19 is repetitive and need not be discussed.

A coordinated summary of the operation of the silo disclosed herein can now be presented. Mixing silo 20 has six discharge apertures 62 at its base, dispersed at even intervals around the periphery of conical hood 30. Six conduits 64 connect the corresponding discharge apertures 62 to a common receptacle, such as homogenizing silo 32. Each conduit is provided with a flow control gate 66 to control the movement of material through the corresponding discharge aperture 62. A level sensor 152 having three level detectors is mounted within the receptacle into which conduits 64 empty. The level sensor signals emitted by level sensor are supplied to a level indicator circuit 168 which includes a memory circuit allowing level indicator signals to be emitted, the value of a level indicator signals depending upon whether material was rising or falling within the receptacle as it traversed certain sensors. These level indicator signals are supplied to mode control circuit 184, which has three mode switches allowing selection of either a single-flow mode, a dual-flow-same-rate mode, or a dual-flow-different-rate mode. In the single-flow mode only one flow control gate is opened at a time, in the dual-flow-same-rate mode opposing flow control gases can be simultaneously opened to the same extent, while in the dual-flow-different-rate mode opposing flow control gates can be simultaneously opened to different extents. The fact that level indicator circuit 168 includes a memory function allows the receptacle to be filled at a relatively fast rate until the material level is near the desired cut-off point, with a slower flow-rate until the cut-off point is achieved, and allows a considerable amount of material to be removed from the receptacle before new material is again introduced.

Timer 246 emits timer signals of predetermined period to flow control gate selector circuit 242, which determines which flow control gates are to be operative. In the single-flow mode, mode control circuit 184 emits a single/dual signal to circuit 242 which results in the sequential selection of the flow control gates, one at a time. In the dual-flow-same-rate mode and in the dual-flow-different-rate mode, the single/dual signal emitted by circuit 184 results in the selection of opposing pairs of flow control gates. Flow control gate selector circuit 242 is connected to a flow control gate selector signal bus 252 having six conductors, one for each of the flow control gates.

Mode control circuit 184 also emits mode signals to a mode control signal bus 224. These mode signals correspond to the level indicator signals emitted by level indicator circuit 168. Moreover, mode control circuit 184 emits alternator signals to three identical alternators 236, 238, and 240. The alternator signals represent two of the level indicator signals generated by level indicator circuit 168.

Each alternator receives flow control gate selection signals from a different pair of the conductors forming flow control gate selector signal bus 252. This allows the alternator to emit alternator signals to one of two pairs of conductors forming alternator signal bus 342 each time the alternator receives the appropriate flow control gate selection signals. These alternator signals correspond to the alternator input signals from mode control circuit 184 which, it will be recalled, in turn represent two of the level indicator signals from level indicator circuit 168.

All six flow control circuits are the same. Each includes a flow control circuit enable conductor connected to a different one of the conductors forming flow control gate selector signal bus 252. All of the flow control circuits have the same connections to mode control signal bus 224. Every other flow control circuit has the same connections to alternator signal bus 342. When a flow control circuit is enabled by an appropriate flow control gate selection signal on bus 252, it responds jointly to the signals on busses 342 and 224 and to flow control gate position signals representing the degree the flow control gate is open. Depending upon what signals are received, the flow control gate either opens wider, narrows, or remains unchanged.

I claim:

1. A silo system for mixing stored material, comprising:

a mixing silo having a plurality of discharge apertures;

a receptacle;

conduit means for conveying material from the discharge apertures to the receptacle;

a plurality of valve means for controlling material flow, each of the valve means controlling material flow through a corresponding one of the discharge apertures;

level sensor means for generating level sensor signals indicative of the material level in the receptacle; and first means responsive to the level sensor signals for temporarily opening valve means in a predetermined sequence when the material level in the receptacle is rising to a first predetermined point and thereafter keeping all of the valve means closed until the material level in the receptacle falls to a second predetermined point below the first predetermined point, said first means additionally comprising means for reducing the rate of flow through temporarily opened valve means when the material level in the receptacle rises to a third predetermined point between the first and second predetermined points.

2. The silo system of claim 1, wherein the level sensor means comprises three level switches mounted within the receptacle at different heights corresponding to the first, second, and third predetermined points, and wherein the first means comprises a level indicator circuit electrically connected to the level switches, said level indicator circuit including at least one memory element.

3. The silo system of claim 1, or 2, wherein the first means comprises means for temporarily opening valve means one after another in a predetermined sequence when the material level in the receptacle is rising to the first predetermined point.

4. The silo system of claim 1, or 2, wherein there is an even number of discharge apertures and the first means comprises means for temporarily opening valve means one pair after another in a predetermined sequence when the material level in the receptacle is rising to the first predetermined point.

5. The silo system of claim 4, further comprising second means cooperating with the first means for opening one valve means of a temporarily opened pair to a different extent than the other, the second means changing which of the pair is opened the wider each time the pair is temporarily opened.

6. The silo system of claim 5, wherein the second means comprises an alternator corresponding to each pair of valve means, each alternator comprising a memory circuit which changes state once each time the corresponding pair of valve means is temporarily opened when material in the receptacle is rising.

7. The silo system of claim 1, or 2, wherein the receptacle is an homogenizing silo and wherein the first means comprises a first manually activated switch connected to means for temporarily opening valve means one after another in a predetermined sequence when the material level in the receptacle is rising to the first predetermined point and a second manually activated switch connected to means for temporarily opening valve means one pair after another in a predetermined sequence when the material level in the receptacle is rising to the first predetermined point.

8. The silo system of claim 7, wherein each valve means is a flow control gate having a rotatably mounted cylinder with an opening therein and a shaft axially connected to the cylinder, and the first means additionally comprising third means operationally connected to the shaft for generating signals corresponding to the angular position of the shaft.

9. The silo system of claim 8, wherein the third means comprises a plurality of switches mounted for sequential activation as the shaft rotates.

10. The silo system of claim 8, wherein the third means comprises potentiometer means operationally connected to the shaft for generating signals of variable voltage and means for comparing the signals with a plurality of predetermined voltages.

11. The silo system of claim 8, further comprising at least one aeration element corresponding to each discharge aperture and mounted within the mixing silo adjacent the corresponding discharge aperture, and fourth means connected to the first means for periodically blowing air through said at least one aeration element.

12. The silo system of claim 11, wherein the conduit means comprises a plurality of fluid slides, each fluid slide conveying the discharge from one discharge aperture to the receptacle.

13. The silo system of claim 12, further comprising a conduit leading from the homogenizing silo to a weighing bin.

14. A silo system for mixing stored material, comprising:

a mixing silo having a conical hood mounted at the base thereof and a plurality of discharge apertures disposed about the periphery of the hood at substantially equal angular intervals;

an homogenizing silo beneath the hood;

a conduit corresponding to each discharge aperture and connecting the corresponding discharge aperture to the homogenizing silo;

valve means mounted on each conduit for controlling material flow through the corresponding discharge aperture;

a level sensor mounted within the homogenizing silo;

first means cooperating with the level sensor and with each of the valve means for allowing material to simultaneously flow through a pattern of more than one but less than all of the discharge apertures until the material in the homogenizing silo rises to a predetermined point between the top and the bottom thereof, the pattern being identified by a plurality of lines drawn from the axis of the conical hood to the discharge apertures through which material flows, the pattern of discharge apertures through which material flows being rotated at predetermined intervals; and second means cooperating with the first means for maintaining the flow rate through at least one of the discharge apertures on the rotating pattern at a value different than the flow rate through at least one other discharge aperture on the rotating pattern;

wherein there is an even number of discharge apertures and wherein material is allowed to simultaneously flow through an opposing pair of discharge apertures, the pattern being a substantially straight line, and wherein the second means comprises one alternator means corresponding to every opposing pair of discharge apertures, each alternator means comprising memory means for determining whether material has flowed through the corresponding pair of flow control gates an odd or an even number of times as the material rises to the predetermined point.

15. The silo of claim 14, further comprising third means cooperating with the first and second means for reducing the flow rate through each opposing pair of discharge apertures before the material in the homogenizing silo rises to the predetermined point.

16. The silo of claim 15, wherein each conduit comprises a fluid slide and wherein each valve means comprises a flow control gate mounted on the corresponding conduit.

17. The silo system of claim 16, further comprising means for periodically injecting air into the mixing silo adjacent the discharge apertures.

18. A silo system for mixing stored material, comprising:

a mixing silo having a plurality of discharge apertures;

a receptacle;

conduit means for conveying material from the discharge apertures to the receptacle;

a plurality of valve means through which material flows for controlling material flow, each of the valve means controlling material flow through a corresponding one of the discharge apertures by selectively obstructing the conduit means;

level sensor means for generating level sensor signals indicative of the material level in the receptacle; and first means responsive to the level sensor signals for temporarily opening valve means in a predetermined sequence when the material level in the receptacle is rising to a first predetermined point and thereafter keeping all of the valve means closed until the material level in the receptacle falls to a second predetermined point below the first predetermined point, the first means further including means for reducing the rate of material flow through temporarily opened valve means when the material level in the receptacle rises to a third preselected point between the first and second predetermined points.

19. The silo system of claim 18, wherein the level sensor means comprises three level switches mounted within the receptacle at different heights corresponding to the first, second, and third predetermined points, and wherein the first means comprises a level indicator circuit electrically connected to the level switches, said level indicator circuit including at least one memory element.

20. The silo system of claim 18, or 19, wherein the first means comprises means for temporarily opening valve means one after another in a predetermined sequence when the material level in the receptacle is rising to the first predetermined point.

21. The silo system of claim 18, or 19, wherein there is an even number of discharge apertures and the first means comprises means for temporarily opening valve means one pair after another in a predetermined sequence when the material level in the receptacle is rising to the first predetermined point.

22. The silo system of claim 21, further comprising second means cooperating with the first means for opening one valve means of a temporarily opened pair to a different extent than the other, the second means changing which of the pair is opened the wider each time the pair is temporarily opened.

23. The silo system of claim 22, wherein the second means comprises an alternator corresponding to each pair of valve means, each alternator comprising a memory circuit which changes state once each time the corresponding pair of valve means is temporarily opened when material in the receptacle is rising.

24. A silo system for mixing stored material, comprising:

a mixing silo having a plurality of discharge apertures;

a receptacle;

conduit means for conveying material from the discharge apertures to the receptacle;

a plurality of valve means through which material flows for controlling material flow, each of the valve means controlling material flow through a corresponding one of the discharge apertures by selectively obstructing the conduit means;

level sensor means for generating level sensor signals indicative of the material level in the receptacle; and first means responsive to the level sensor signals for temporarily opening valve means in a predetermined sequence when the material level in the receptacle is rising to a first predetermined point and thereafter keeping all of the valve means closed until the material level in the receptacle falls to a second predetermined point below the first predetermined point, wherein the receptacle is an homogenizing silo and wherein the first means includes a first manually activated switch connected to means for temporarily opening valve means one after another in a predetermined sequence when the material level in the receptacle is rising to the first predetermined point and a second manually activated switch connected to means for temporarily opening valve means one pair after another in a predetermined sequence when the material level in the receptacle is rising to the first predetermined point.

25. The silo system of claim 24, wherein each valve means is a flow control gate having a rotatably mounted cylinder with an opening therein and a shaft axially connected to the cylinder, and the first means additionally comprising additional means operationally connected to the shaft for generating signals corresponding to the angular position of the shaft.

26. The silo system of claim 25, wherein the additional means comprises a plurality of switches mounted for sequential activation as the shaft rotates.

27. The silo system of claim 25, wherein the additional means comprises potentiometer means operationally connected to the shaft for generating signals of variable voltage and means for comparing the signals with a plurality of predetermined voltages.

28. The silo system of claim 25, further comprising at least one aeration element corresponding to each discharge aperture and mounted within the mixing silo adjacent the corresponding discharge aperture, and further means connected to the first means for periodically blowing air through said at least one aeration element.

29. The silo system of claim 28, wherein the conduit means comprises a plurality of fluid slides, each fluid slide conveying the discharge from one discharge aperture to the receptacle.

30. The silo system of claim 29, further comprising a conduit leading from the homogenizing silo to a weighing bin.

31. A silo system for mixing stored material, comprising:

a mixing silo having a conical hood mounted at the base thereof and a plurality of discharge apertures disposed about the periphery of the hood at substantially equal angular intervals;

an homogenizing silo beneath the hood;

a conduit corresponding to each discharge aperture and connecting the corresponding discharge aperture to the homogenizing silo;

valve means through which material flows mounted on each conduit for controlling material flow through the corresponding discharge aperture by selectively obstructing the conduit means;

a level sensor mounted within the homogenizing silo;

first means cooperating with the level sensor and with each of the valve means for allowing material to simultaneously flow through a pattern of more than one but less than all of the discharge apertures until the material in the homogenizing silo rises to a predetermined point between the top and the bottom thereof, the pattern being identified by a plurality of lines drawn from the axis of the conical hood to the discharge apertures through which material flows, the pattern of discharge apertures through which material flows being rotated at predetermined intervals; and second means cooperating with the first means for maintaining the flow rate through at least one of the discharge apertures on the rotating pattern at a value different than the flow rate through at least one other discharge aperture on the rotating pattern, wherein there is an even number of discharge apertures and wherein material is allowed to simultaneously flow through an opposing pair of discharge apertures, the pattern being a substantially straight line, and wherein the second means comprises one alternator means corresponding to every opposing pair of discharge apertures, each alternator means comprising memory means for determining whether material has flowed through the corresponding pair of flow control gates an odd or an even number of times as the material rises to the predetermined point.

32. The silo of claim 31, further comprising third means cooperating with the first and second means for reducing the flow rate through each opposing pair of discharge apertures before the material in the homogenizing silo rises to the predetermined point.

33. The silo of claim 32, wherein each conduit comprises a fluid slide and wherein each valve means comprises a flow control gate mounted on the corresponding conduit.

34. The silo system of claim 33, further comprising means for periodically injecting air into the mixing silo adjacent the discharge apertures.

* * * * *